US006101695A

United States Patent [19]

Nakamura et al.

[11] Patent Number: 6,101,695

[45] Date of Patent: Aug. 15, 2000

[54] APPARATUS FOR PRODUCING A WIRING HARNESS

[75] Inventors: Atsushi Nakamura; Masashi Sato, both of Yokkaichi, Japan

[73] Assignee: Sumitomo Wiring Systems, Ltd., Japan

[21] Appl. No.: 09/369,240

[22] Filed: Aug. 5, 1999

Related U.S. Application Data

[62] Division of application No. 08/853,564, May 8, 1997.

[30] Foreign Application Priority Data

| | | | |
|---|---|---|---|
| May 9, 1996 | [JP] | Japan | 8-114747 |
| May 9, 1996 | [JP] | Japan | 8-114748 |
| May 9, 1996 | [JP] | Japan | 8-114749 |
| Sep. 25, 1996 | [JP] | Japan | 8-252932 |
| Sep. 25, 1996 | [JP] | Japan | 8-252933 |

[51] Int. Cl.[7] ..... B21B 15/00

[52] U.S. Cl. ..... 29/33 M; 29/748; 29/861

[58] Field of Search ..... 29/33 M, 825, 29/829, 850, 861, 566.1, 564.6, 748, 755

[56] References Cited

U.S. PATENT DOCUMENTS

| | | | |
|---|---|---|---|
| 3,911,201 | 10/1975 | Fry . | |
| 4,154,977 | 5/1979 | Verma . | |
| 4,235,015 | 11/1980 | Funcik et al. | 29/857 |
| 4,253,222 | 3/1981 | Brown et al. . | |
| 4,551,893 | 11/1985 | Ikeda et al. | 29/33 M |
| 4,616,396 | 10/1986 | Matsui . | |
| 4,880,943 | 11/1989 | Kuzuno et al. . | |
| 4,932,110 | 6/1990 | Tanaka . | |
| 5,010,642 | 4/1991 | Takahashi et al. . | |
| 5,052,449 | 10/1991 | Fukuda et al. . | |
| 5,074,038 | 12/1991 | Fath . | |
| 5,230,146 | 7/1993 | Tsuji et al. . | |
| 5,230,147 | 7/1993 | Asaoka et al. . | |
| 5,282,311 | 2/1994 | Tamura . | |
| 5,483,738 | 1/1996 | Watanabe et al. . | |
| 5,518,570 | 5/1996 | Takagi et al. . | |
| 5,673,475 | 10/1997 | Takahashi . | |
| 5,732,750 | 3/1998 | Soriano . | |
| 5,745,975 | 5/1998 | Heisner et al. . | |
| 5,745,982 | 5/1998 | Klinedinst | 29/753 |
| 5,771,574 | 6/1998 | Kato et al. . | |

FOREIGN PATENT DOCUMENTS

| | | |
|---|---|---|
| 0 130 743 | 1/1985 | European Pat. Off. . |
| 0 147 081 | 3/1985 | European Pat. Off. . |
| 0 531 912 | 3/1993 | European Pat. Off. . |
| 991016 | 9/1951 | France . |
| 1 180 020 | 3/1964 | Germany . |
| 01014812 | 2/1987 | Japan . |
| 63-128626 | 8/1988 | Japan . |
| 01183004 | 4/1989 | Japan . |
| 1-177813 | 6/1989 | Japan . |
| 1-197916 | 8/1989 | Japan . |
| 2-94211 | 1/1990 | Japan . |
| 2-278615 | 4/1990 | Japan . |
| 07006632 | 1/1993 | Japan . |
| 07303319 | 3/1995 | Japan . |
| 574612 | 1/1946 | United Kingdom . |

*Primary Examiner*—S. Thomas Hughes
*Assistant Examiner*—Kevin G. Vereene
*Attorney, Agent, or Firm*—Anthony J. Casella; Gerald E. Hespos; Michael J. Porco

[57] ABSTRACT

A wiring harness producing apparatus is provided which has an excellent space efficiency and a simple construction, and is capable of easily and efficiently producing a wiring harness. There are provided a wire feeding unit 21 for feeding a plurality of wires 11, a wire aligning unit 23 for aligning the respective wires 11 in parallel with each other, and a wire arrangement table 24 for linearly arranging the wires 11 aligned in parallel with each other. On the wire arrangement table 24, a connector connecting unit 26 for pressingly connecting a connector 25 with the respective wires 11, a wire lifting unit 28 for lifting the wires 11, circuit length adjusting units 29 each including a wire length adjusting tool 14 formed with steps 15 with a specified inclination which are brought into pressing contact with the wires 11 to set different loosened lengths for the respective wires 11, and a connector fixing unit 27 for fixing the connector 25 are provided along a wire feeding direction P.

7 Claims, 15 Drawing Sheets

APPARATUS FOR PRODUCING A WIRING HARNESS

This application is divisional of Appl. No. 08/853,564 filed May 8, 1997.

BACKGROUND OF THE INVENTION

1. Field of the Invention

The present invention relates to a method and an apparatus for producing a wiring harness used, for example, in an internal wiring of an office automation (OA) equipment, a home electric appliance or an automotive vehicle.

2. Description of the Prior Art

A known wiring harness for electrical connection arranged in an OA equipment, a home electric appliance or an automotive vehicle is, for example, constructed such that a plurality of wires 1 for connecting a CPU, a display device and a variety of switches are bundled as shown in FIG. 28. The wiring harness of this type is produced by mounting fittings and/or jigs for holding a connector 3 and wires 1 on a flat plate in accordance with an actual wiring path. The wires 1 then are arranged manually on the jigs, and an adhesive tape 2 then is wound for protection around a bundle of wires 1. The wire bundle then is covered with an unillustrated resin-molded casing to hold it in a specified configuration, and the cased wire bundle is mounted so as to conform to a wiring path inside an OA equipment, a home electric appliance, an automotive vehicle or the like (first prior art). However, according to this prior art, it takes a large amount of time to wind the adhesive tape 2 after the arrangement of the wire bundle on the jigs, thereby lowering a work efficiency.

There are also known flat cables having a multitude of contacts such as flexible print cables (FPC) in which a pattern of conductive paths 4 is printed on a flexible base film 5 which is then overlaid with a cover film 6, as shown in FIGS. 29 and 30. However, in the case of a complicated wiring harness having curved conductive paths 4, an etching mask is applied for each pattern in a production process, and after the patterns are formed in a large base film Dk, a patterned portion is punched and cut off as shown in FIG. 30. Thus, large apparatuses such as an etching apparatus and a cutting apparatus are required. Further, the use of the large base film Dk necessitates a large work space, leading to a poor space efficiency.

Further, as shown in FIG. 31, there is also a known method for linearly arranging a plurality of strip-like conductors 8 in parallel with each other, laying films 5, 6 on the opposite sides of the conductors 8, and folding the thus obtained flat cable according to a wiring path. According to this method, the apparatuses required for the prior art of FIGS. 29 and 30 can be dispensed with. However, in the wiring harness obtained according to this prior art, folded portions 9 may be damaged or a portion between the folded portions 9 may be deformed in such a three-dimensional manner to part from the remaining parts of the wiring harness due to the elastic restoration of the folded portions 9 as shown in FIG. 32. This presents a problem that the configuration of the wiring harness cannot stably conform to the wiring path.

An object of the present invention is to provide a method for easily and efficiently producing a wiring harness using an apparatus having an excellent space efficiency and a simple construction and also to provide such a wiring harness producing apparatus.

SUMMARY OF THE INVENTION

According to the invention, there is provided a method for producing a wiring harness, comprising a wire connecting step of preferably substantially linearly feeding a plurality of wires preferably substantially in parallel with each other to a connector connecting unit located at an upstream side with respect to a wire feeding direction. This step is completed by connecting the respective wires with a connector set in the connector connecting unit. The method then includes a connector moving/fixing step of moving and/or fixing the connector connected with the respective wires to a connector fixing unit located at a downstream side with respect to the wire feeding direction, thereby substantially linearly arranging the wires substantially in parallel with each other from the upstream side to the downstream side. The method proceeds with a circuit or wire length adjusting step of pressing and/or moving a wire length adjusting tool. The wire length adjusting tool then may be formed with steps or recesses forming wire positioning means, in particular with a specified inclination against the wires, to set different loosened lengths for the respective wires. A connecting/cutting step then is provided for connecting the wires with the connector, preferably set in the connector connecting unit, and/or cutting the wires upstream of the connector.

According to a preferred embodiment of the invention, the method further comprises a wire lifting step of lifting the wires by a wire lifting device, preferably provided slightly downstream from the connector connecting unit, and/or a connector setting step of setting at least one connector in the connector connecting unit, preferably while the wires are lifted. The connecting/cutting step preferably comprises the step of lowering the wires lifted by the wire lifting device after the loosened lengths of the wires are set in the circuit length adjusting step.

Two connectors preferably are settable along the wire feeding direction in the connector connecting unit. Thus the wires are connected with the connectors at a rear end of a downstream wiring harness and at a front end of an upstream wiring harness. The wires then may be cut between the connection positions of both connectors in the connecting/cutting step.

The method may further comprise a wire fixing step of fixedly holding the respective wires after the connector moving/fixing step by a wire fixing device. The wire fixing device preferably is provided slightly upstream from the connector fixing unit, and the wire fixing step may be performed before the circuit length adjusting step.

Most preferably, the circuit length adjusting step is repeated and/or performed at different positions of the wires along the wire feeding direction.

According to a further preferred embodiment, the method further comprises a wire lowering step of lowering the wire lifted by the wire lifting device after the completion of the circuit length adjusting step.

Preferably, the method further comprises a downstream wire portion fixing step. This step involves fixing portions of adjacent wires to each other, preferably by adhering a connecting sheet member over the substantially linear and/or substantially parallel portions of the respective wires, in a position downstream from where the circuit or wire length adjusting unit is pressed down. The downstream wire portion fixing step preferably is performed before the circuit length adjusting step. The method may further include an upstream wire portion fixing step. This step may include fixing portions of adjacent wires to each other, preferably by adhering a connecting sheet member over the substantially linear and/or substantially parallel portions of the respective wires, in a position upstream from where the preferably most upstream circuit or wire length adjusting unit is pressed down. The upstream wire portion fixing step preferably is performed after the completion of the circuit length adjusting step, preferably of the wire lowering step.

According to the invention, there is further provided an apparatus for producing a wiring harness. The apparatus may specifically be constructed for performing the above-described method of the invention. The apparatus may comprise a wire feeding unit for feeding a plurality of wires and a wire arrangement table or means for substantially linearly arranging the plurality of wires. A connector connecting unit may be provided at an upstream side of the wire arrangement table with respect to a wire feeding direction for connecting a set connector with the respective wires. A connector fixing unit may be provided at a downstream side of the wire arrangement table with respect to the wire feeding direction for fixing the connector connected with the wires. A wire lifting unit slightly downstream from the connector connecting unit may be provided for lifting the wires. The apparatus further comprises a circuit or wire length adjusting unit in a position corresponding to an intermediate position of the wires. The circuit or wire length adjusting unit comprises a wire length adjusting tool formed with wire positioning means. The wire length adjusting tool preferably includes steps or recesses in particular having a specified inclination, which are to be brought into pressing contact with the wires on the wire arrangement table to set different loosened lengths for the respective wires.

According to a further preferred embodiment the apparatus further comprises a wire aligning unit for aligning, substantially in parallel the plurality of wires fed from the wire feeding unit.

Preferably, the circuit or wire length adjusting unit is provided between the connector fixing unit and the wire lifting unit.

Further preferably, the connector connecting unit is constructed such that two connectors are settable along the wire feeding direction. Preferably the connector connecting unit comprises pressing devices for pressing the wires so as to connect them with the respective connectors. The connector connecting unit preferably also has at least one wire cutter for cutting the wires between the connection positions of both connectors.

The apparatus may further comprise a wire fixing unit, which may be provided between the connector fixing unit and the circuit length adjusting unit. The wire fixing unit may include means for fixedly holding the respective wires in at least one predetermined or predeterminable position.

The apparatus may further comprise at least one wire portion fixing unit which may include sheet member adhering units. The wire portion fixing unit may be between the connector fixing unit, the circuit length adjusting unit and/or the connector connecting unit for fixing adjacent wire portions to each other, in particular by adhering a connecting sheet member over the substantially linear and/or substantially parallel portions of the respective wires.

According to a further preferred embodiment the wiring harness producing method comprises a wire connecting step of linearly feeding a plurality of wires in parallel with each other to a connector connecting unit located at an upstream side with respect to a wire feeding direction and connecting the respective wires with a connector set in the connector connecting unit. The method proceeds with a connector moving/fixing step of moving and fixing the connector connected with the respective wires to a connector fixing unit located at a downstream side with respect to the wire feeding direction. This step linearly arranges the wires in parallel with each other from the upstream side to the downstream side. The method then includes a wire lifting step of lifting the wires linearly arranged in parallel with each other from the upstream side to the downstream side by a wire lifting device provided slightly downstream from the connector connecting unit. The method continues with a connector setting step of setting a connector in the connector connecting unit while the wires are lifted. The subject method then includes a circuit length adjusting step of pressing a wire length adjusting tool formed with steps with a specified inclination against the lifted wires to set different loosened lengths for the respective wires. The method may conclude with a connecting/cutting step of lowering the wires lifted by the wire lifting device after the loosened lengths of the wires are set in the circuit length adjusting step, connecting the wires with the connector set in the connector connecting unit, and cutting the wires.

As described above, a plurality of wires are linearly arranged in parallel with each other and the wire length adjusting tool is pressed against the wires to set the different loosened lengths for the respective wires. The wires then can be fed at a high speed and a curved portion in conformity with a desired wiring path can easily be formed by the respective wires while space efficiency is improved. Accordingly, the wiring harness can easily and efficiently be produced by a simple apparatus without requiring large apparatuses as in the prior art.

Preferably, the producing method may be such that two connectors are set along the wire feeding direction in the connector connecting unit, the wires are connected with the connectors at a rear end of a downstream wiring harness and at a front end of an upstream wiring harness and the wires are cut between the connection positions of both connectors in the connecting/cutting step.

Accordingly, the continuous production of wiring harnesses can efficiently be performed.

The producing method may also be such that there is further provided a wire fixing step of fixedly holding the respective wires after the connector moving/fixing step by a wire fixing device provided slightly upstream from the connector fixing unit. The wire fixing step is performed before the circuit length adjusting step. Accordingly, stable connection between the connector and the wires can be satisfactorily ensured.

According to a further preferred embodiment of the invention, there is provided a wiring harness producing apparatus comprising a wire feeding unit for feeding a plurality of wires, and a wire aligning unit for aligning in parallel the plurality of wires fed from the wire feeding unit. The apparatus further includes a wire arrangement table for linearly arranging the plurality of wires aligned in parallel with each other by the wire aligning unit. A connector connecting unit is provided at an upstream side of the wire arrangement table with respect to a wire feeding direction for connecting a set connector with the respective wires. A connector fixing unit is provided at a downstream side of the wire arrangement table with respect to the wire feeding direction for fixing the connector connected with the wires. A wire lifting unit is provided slightly downstream from the connector connecting unit for lifting the wires, and a circuit length adjusting unit is provided between the connector fixing unit and the wire lifting unit. The circuit length adjusting unit comprises a wire length adjusting tool formed with steps with a specified inclination which are to be brought into pressing contact with the wires on the wire arrangement table to set different loosened lengths for the respective wires.

Preferably, in the producing apparatus, the connector connecting unit may be constructed such that two connectors are settable along the wire feeding direction, and may comprise pressing devices for pressing the wires so as to connect them with the respective connectors and a wire cutter for cutting the wires between the connection positions of both connectors.

The producing apparatus may also comprise a wire fixing device between the connector fixing unit and the circuit length adjusting unit and comprising a wire fixing device for fixedly holding the respective wires.

According to a still further preferred embodiment, there is provided a wiring harness producing method comprising a wire connecting step of linearly feeding a plurality of wires in parallel with each other to a connector connecting unit located at an upstream side with respect to a wire feeding direction and connecting the respective wires with a connector set in the connector connecting unit. The method then includes a connector moving/fixing step of moving and fixing the connector connected with the respective wires to a connector fixing unit located at a downstream side with respect to the wire feeding direction, thereby linearly arranging the wires in parallel with each other from the upstream side to the downstream side. The method continues with a wire lifting step of lifting the wires linearly arranged in parallel with each other from the upstream side to the downstream side by a wire lifting device provided slightly downstream from the connector connecting unit. A connector setting step then is provided of setting a connector in the connector connecting unit while the wires are lifted. A circuit length adjusting step of the subject method includes pressing a wire length adjusting tool formed with steps with a specified inclination against the lifted wires to set different loosened lengths for the respective wires. The method continues with a downstream sheet member adhering step of adhering a connecting sheet member over the linear and parallel portions of the respective wires in a position downstream from the position where the wire length adjusting tool fixes the wires to each other. The downstream sheet member adhering step preferably is performed before the circuit length adjusting step. A wire lowering step including lowering the wires lifted by the wire lifting device after the completion of the circuit length adjusting step. An upstream sheet member adhering step then is provided and includes adhering a connecting sheet member over the linear and parallel portions of the respective wires in a position upstream from a position where the most upstream wire length adjusting tool is pressed down to fix the wires to each other. The upstream sheet member adhering step is performed after the completion of the wire lowering step. The method then may conclude with a connecting/cutting step of connecting the wires with the connector set in the connector connecting unit and cutting the wires after the completion of the wire lowering step.

According to still a further embodiment, there is provided a wiring harness producing apparatus comprising a wire feeding unit for feeding a plurality of wires, and a wire aligning unit for aligning in parallel the plurality of wires fed from the wire feeding unit. The apparatus then includes a wire arrangement table for linearly arranging wires aligned by the wire aligning unit. The apparatus then comprises a connector connecting unit at an upstream side of the wire arrangement table with respect to a wire feeding direction for connecting a set connector with the respective wires. A connector fixing unit is provided at a downstream side of the wire arrangement table with respect to the wire feeding direction for fixing the connector connected with the wires, and a wire lifting unit provided slightly downstream from the connector connecting unit for lifting the wires. The apparatus then includes a circuit length adjusting unit between the connector fixing unit and the wire lifting unit and comprising a wire length adjusting tool. The wire length adjusting tool is formed with steps with a specified inclination which are to be brought into pressing contact with the wires on the wire arrangement table to set different loosened lengths for the respective wires. The apparatus then has sheet member adhering units between the connector fixing unit, the circuit length adjusting unit and the connector connecting unit for adhering a connecting sheet member over the linear and parallel portions of the respective wires to fix the wires to each other.

According to a further aspect of the invention, there is provided a wiring harness, comprising at least one specified wire group made of a plurality of wires preferably covered with an insulating coating, which extend through at least one curved portion where they are arranged at specified intervals along substantially concentrical arcs and, substantially linearly, through at least one linear portion which is continuous with the curved portion. The wiring harness further includes at least one fixing means provided at least at the linear portion so as to fix the respective wires together outside the curved portion.

According to a preferred embodiment of the invention, the fixing means comprises a sheet member adhered to at least the linear portion.

Preferably the wiring harness further comprises at least one protection film which is separate from the fixing means, in particular from the sheet member and adhered to the curved portion, for fixing the wires there. The protection film preferably has a shape similar to that of the curved portion.

According to a further aspect of the invention, there is further provided a method for producing a wiring harness comprising a first step of linearly arranging a plurality of wires substantially in parallel with each other. The method includes a second step of setting different loosened lengths for the wires of the specified wire group by pressing a tool formed with steps with a specified inclination against the wires or by bringing a loosened length adjusting means in close contact with the respective wires, to compensate for length differences between adjacent arcs of the wires of the finished wiring harness. The method then includes a third step of fixing a plurality of wires by adhering a film or sheet member over the plurality of wires, outside the loosened lengths thereof.

According to a preferred embodiment, the method comprises a fourth step of establishing the desired position or configuration of the curved and linear portions of the wiring harness and adhering the protection film to the curved portion.

Preferably, in the first step, the plurality of wires are arranged to extend over an opening which is provided in a predetermined or predeterminable position of a surface of a placing table, and in the second step, the respective wires are pushed into the opening using the loosened length adjusting means.

According to the invention, there is further provided an apparatus for producing a wiring harness with a wire feeding means for feeding a plurality of wires. The apparatus also includes a placing table comprising at least one table module, for linearly placing the plurality of wires and a loosened length adjusting means provided with wire positioning means, comprising preferably steps or recesses or wire positioning means, extending at an angle different from 0° or 180°, preferably approximately transversely or normal to the wires, which set different loosened lengths of the respective wires when brought into pressing contact with the wires on or at the placing table means.

According to a preferred embodiment of the invention, steps or recesses have a specified inclination, which is defined in accordance with the desired setting of the different loosened lengths of the respective wires.

Preferably the apparatus further comprises wire aligning means for aligning in parallel the plurality of wires fed from the wire feeding means.

Further preferably, at least one opening is formed in a predetermined or predeterminable position of a surface of the placing table, in particular in a placing table module thereof or between two adjacent placing table modules thereof, through or into which the loosened length adjusting means is movable to push the respective wires after being brought into contact with the respective wire positioning means, in particular steps or recesses, thereof, wherein the opening has preferably a width along the longitudinal direction of the wires such that the wires are smoothly bent when they are pushed by the respective wire positioning means.

Preferably, the placing table further comprises a sheet member adhering table module for adhering a sheet member to the linear portion of the plurality of wires after the setting of the different loosened lengths and/or a protection film adhering table module for adhering a protection film to the curved portion of the plurality of wires.

Further preferably, the placing table means further comprises at least one connector connecting table module for connecting at least one connector with at least a part of the plurality of wires after the setting of the different loosened lengths thereof by the wire length adjusting means.

According to still a further preferred embodiment, the portion of the wire length adjusting means coming into contact with the wires and/or the edges of the placing table is/are rounded off.

Preferably, the height hn of the n-th step corresponding to the n-th wire of the plurality of wires is approximately given by the following formula:

$$h_n \approx \sqrt{\left(\frac{L_n}{2}\right)^2 - \left(\frac{a}{2}\right)^2} = \frac{1}{2}\sqrt{L_n^2 - a^2}$$

wherein Ln is the length of the bent portion of the n-th wire and a is the width of an opening of the table placing along the longitudinal direction of the wires, wherein the length Ln preferably is given by the following approximative equation:

$$L_n \approx 2\pi n w = \frac{\varepsilon[°]}{360°}$$

wherein $\epsilon$ is the bending angle by which the wires are bent and w is the distance between adjacent wires, wherein the equations for the height hn of the n-th step and/or for the length Ln of the n-th wire is/are preferably adopted for $n \geqq 4$. Thus the height hn can be determined within a predetermined level of accuracy.

Most preferably, the wire positioning means, in particular the steps or recesses are spaced from each other, preferably in the lateral direction of the wire length adjusting means, depending upon or in correspondence with the spacing(s) of the wires.

These and other objects, features and advantages of the present invention will become more apparent upon a reading of the following detailed description and accompanying drawings.

DETAILED DESCRIPTION OF THE PREFERRED EMBODIMENTS

Figure 1:
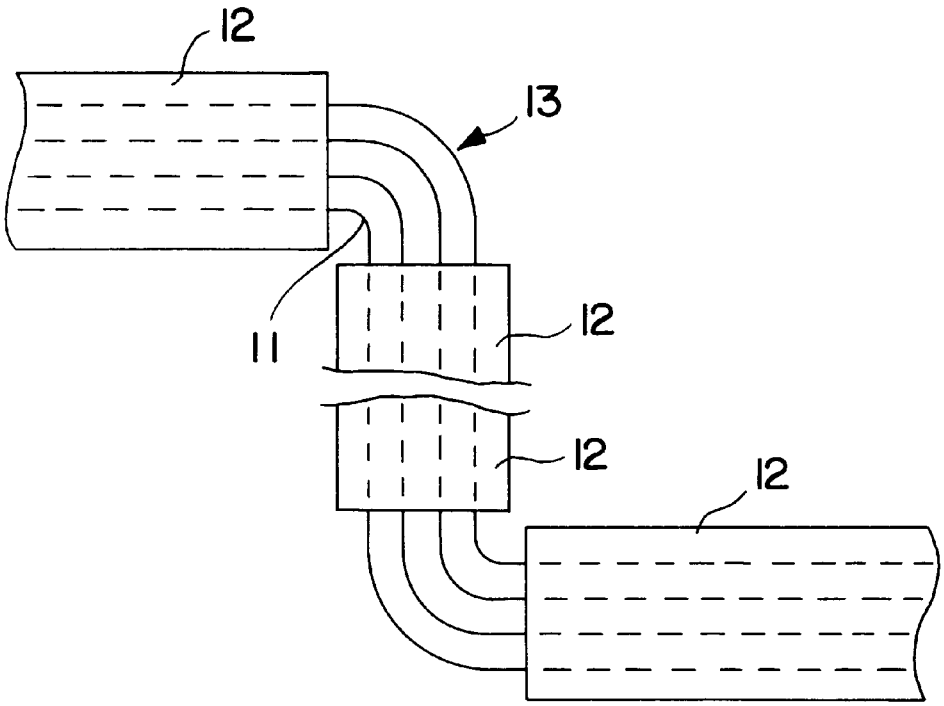
FIG. 1 is a plan view of an example of a wiring harness produced according to one embodiment of the invention.

FIG. 1 is a diagram of an example of a wiring harness produced according to one embodiment of the invention. In this wiring harness, a plurality of wires 11 are arranged substantially in parallel at substantially even intervals on the same plane, and are at least partially secured to each other by being partly held between two insulation tapes 12 or the like holding means (e.g. soldering or gluing of the insulation coatings or sheaths of the wires 11, or clamps, clips etc.) for fixing the wires or by adhering the insulation tapes 12 from one side. Particularly, in order to conform to a complicated wiring path having curved portions, all wires 11 are curved along substantially concentric arcs at substantially even intervals in each curved portion 13.

The curved portions 13 may also be fixed by the insulation tapes 12, but they are not fixed by the insulation tapes 12 as shown in FIG. 1 in order to simplify the production of the wiring harness. The respective wires 11 used are of the type which are covered with insulating coatings. Although four wires 11 are arranged in this embodiment, the number of the wires 11 is not limited to four provided that the wires 11 are arranged substantially in parallel at substantially even intervals on the same plane, at least within predetermined tolerances. Also substantially uneven spacings or pitches of the wires 11 may be chosen, i.e. the wires must not be equally spaced.

Figure 2:
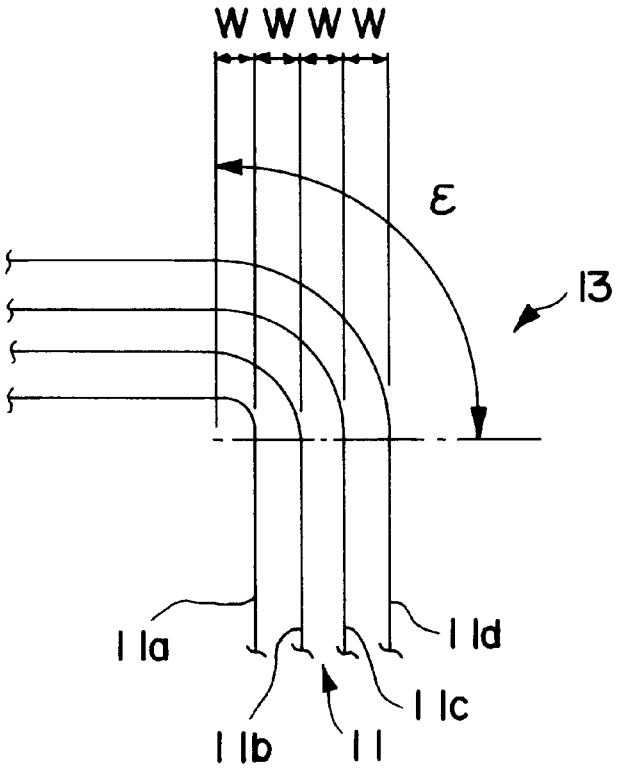
FIG. 2 is a diagram of a curved portion of the wiring harness in which the respective wires are bent at 90°.

FIG. 2 is a diagram showing the wires 11 the longitudinal direction thereof is curved by an angle $\epsilon$ of 90° in the curved portion 13. Since the wires 11 (11*a* to 11*d*) are spaced by a specified distance w in the curved portion 13 of the wiring harness, the lengths of the wires 11 need to be different or to have different lengths.

Assuming that a spacing between the wires 11*a* to 11*d* is w and the radii of curvature of the wires 11*a* to 11*d* are w, 2w, 3w, 4w, respectively, lengths L1, L2, L3, L4 of the wires 11*a* to 11*d* in the curved portion 13 are each a quarter of a circumference of a circle defined by the corresponding radius of curvature:

$$L1=(2\pi\cdot w)/4=\pi w/2$$

$$L2=(2\pi\cdot 2w)/4=\pi w$$

$$L3=(2\pi\cdot 3w)/4=3\pi w/2$$

$$L4=(2\pi\cdot 4w)/4=2\pi w.$$

Differences in length between the neighboring wires are:

$$L2-L1=(\pi w)-(\pi w/2)=\pi w/2$$

$$L3-L2=(3\pi w/2)-(\pi w)=\pi w/2$$

$$L4-L3=(2\pi w)-(3\pi w/2)=\pi w/2.$$

Figure 3:
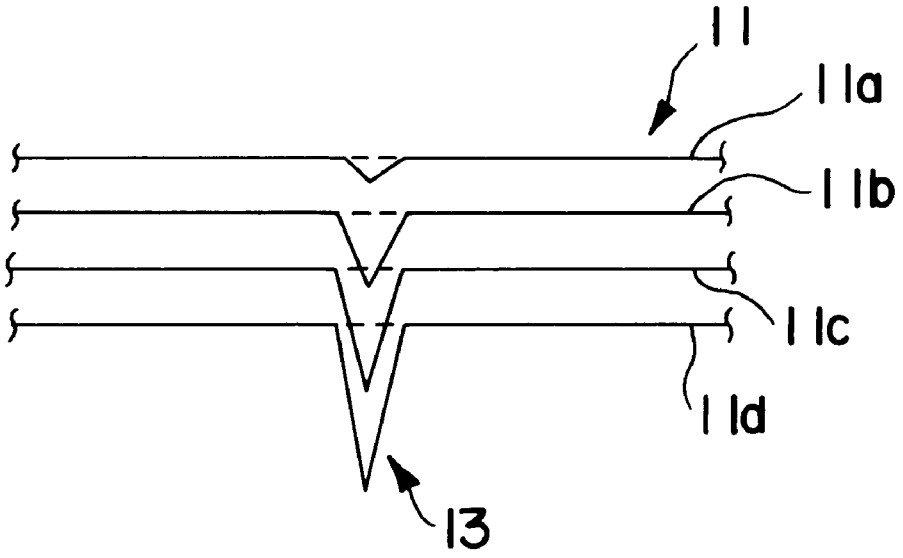
FIG. 3 is a diagram of the wires having the lengths thereof adjusted by a wire length adjusting tool.

Thus, the differences in length between the neighboring wires need to be set at ($\pi$w/2). Although a method of manually arranging the wires 11 along the wiring path or aligning the wires 11 using a jig such as a mold may be adopted as in the first prior art, such a method is poor in work efficiency and space efficiency. Accordingly, in this embodiment, the lengths of the wires 11 are differed in the following manner. After the wires 11 are substantially linearly arranged in parallel with each other as indicated in broken lines in FIG. 3, a wire length adjusting tool 14 (loosened length adjusting means) formed with recesses or grooves or steps 15 (forming wire positioning means) of specified height ($\Delta$H) corresponding to the difference between the wire lengths and depending in particular from the shape or the configuration of the tool head, at specified intervals (w) of the wires 11*a* to 11*d* is used to push the wires 11*a* to 11*d* preferably straight down to loosen them by predetermined or predeterminable lengths, thereby suitably adjusting the lengths of the wires 11*a* to 11*d* to form the curved portion 13 as indicated by solid lines in FIG. 3. The respective steps 15 of the wire length adjusting tool 14 are preferably substantially in the form of an arcuate or triangular or bevelled recess so as to prevent the wires 11*a* to 11*d* from getting out of the steps 15.

An apparatus used to produce the above wiring harness is as shown in FIGS. 6 to 12. This apparatus is provided with a wire feeding unit 21, a wire aligning unit 23, a wire arrangement table 24, a connector connecting unit 26 generally in use, a connector fixing unit 27, a connector lifting unit 28 and circuit length adjusting units 29. The wire feeding unit 21 includes a plurality of wire feeding drums 20, in particular for simultaneously and individually feeding wires 11. The wire aligning unit 23 includes a wire aligning device 22 formed with grooves 22*a* for aligning the predetermined or predeterminable spacing (w) of the plurality of fed wires 11. The wire arrangement table 24 linearly extends along a feeding direction P of the wires fed via the wire aligning unit 23. The connector connecting unit 26 is provided at an upstream side or portion of the wire arrangement table 24 with respect to the feeding direction P and is adapted to connect the wires 11 with a set specified connector 25. The connector fixing unit 27 is provided at a downstream side or portion of the wire arrangement table 24 with respect to the feeding direction P and is adapted to detachably fix the connector 25. The wire lifting unit 28 is provided slightly upstream from the connector connecting unit 26 with respect to the feeding direction P and includes a wire lifting device 28*a* for lifting the respective wires 11.

Each circuit length adjusting unit 29 is provided between the wire lifting unit 28 and the connector fixing unit 27 and is adapted to adjust the lengths of the respective wires 11 (11*a* to 11*d*) using the aforementioned tool 14.

The length Ln of the curved portion 13 of the n-th wire of the plurality of wires 11 corresponds to a height hn of the recess or step 15, by which the n-th wire is to be pressed into the opening 29, wherein the height hn is referred to a reference height 14*h* (FIG. 4) and the height of the n-th step ΔHn is given by the formula:

$$\Delta H_n = h_n - h_{n-1}$$

wherein the heights ΔHn are preferably all equal, if the wires 11 are to be arranged with a single bending or angle ϵ. In case the wires 11 shall be arranged with two or more different angles ϵ, ϵ', ϵ", etc. the heights ΔHn of the steps 15 are preferably groupwise equal (as e.g. in FIG. 27(A)).

Figure 5A:
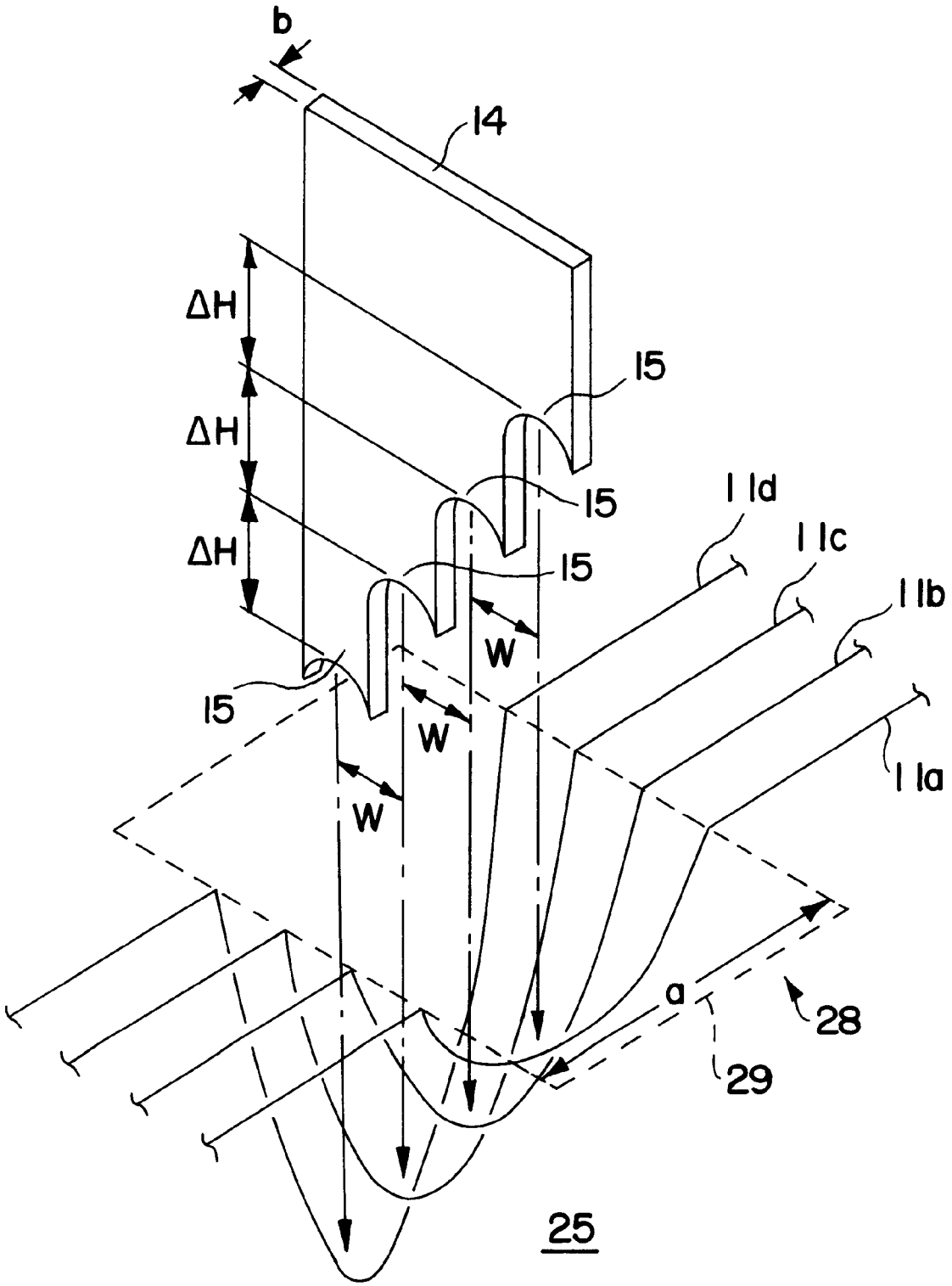
FIG. 5(A) is a perspective view showing an operation of adjusting the lengths of the wires at the curved portion using the tool of FIG. 4.
Figure 5B:
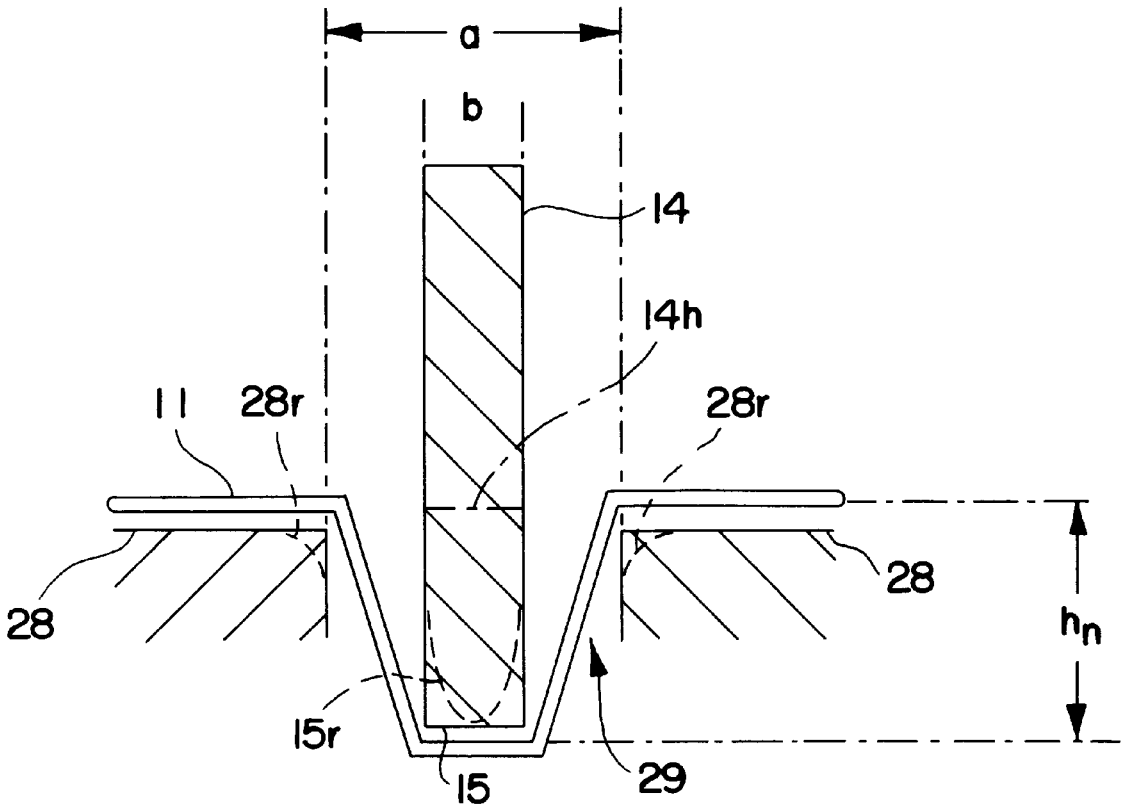
FIG. 5(B) is a schematic sectional view showing in an operation of the wire length adjusting tool pressing the wire into the opening.
Figure 5C:
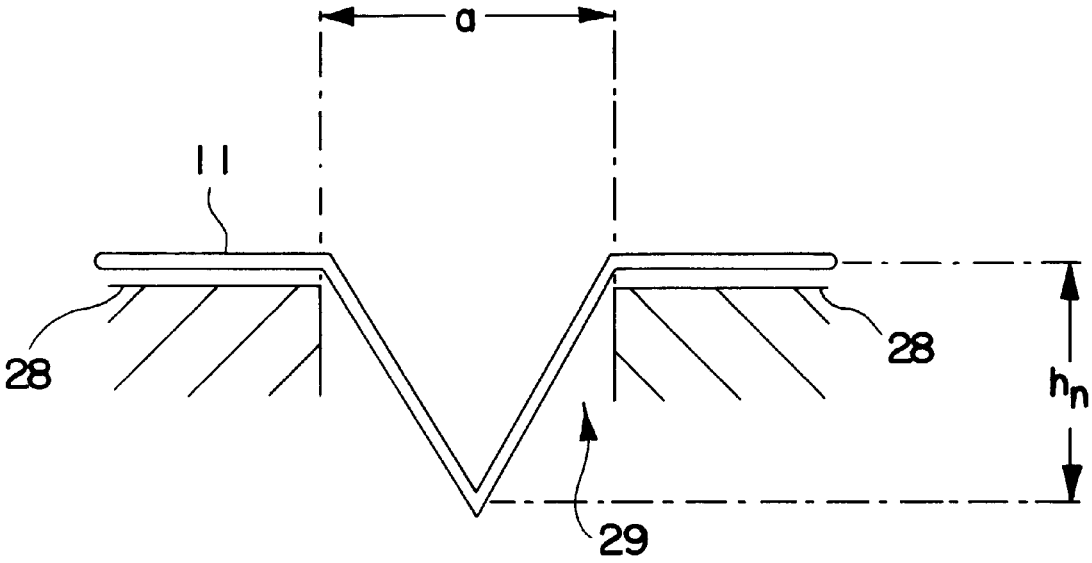
FIG. 5(C) is a simplified sectional view showing a simplified scheme for determining the approximative heights of the steps of the wire length adjusting means.
Figure 6:
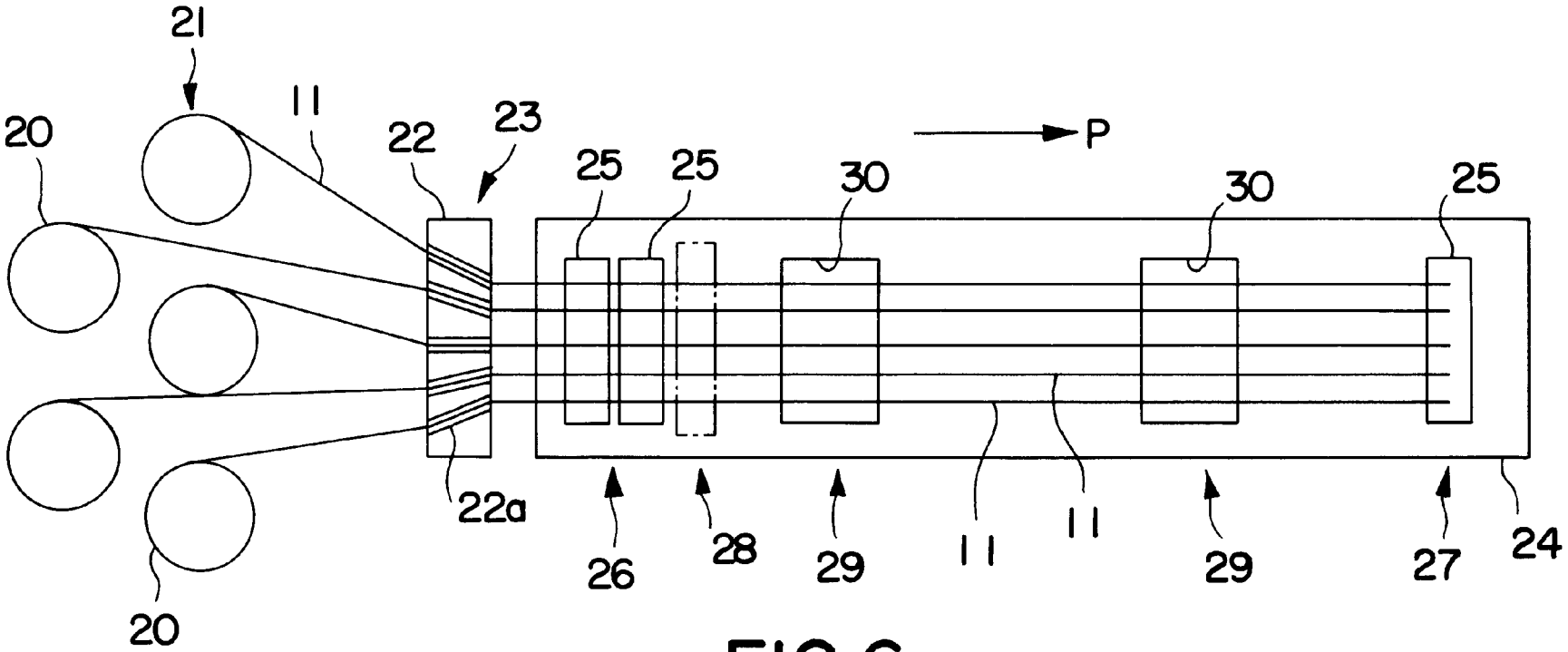
FIG. 6 is a schematic plan view of a producing apparatus according to the embodiment.

A relationship between the height hn of the n-th step 15 and the length Ln of the n-th wire of the plurality of wires 11 can be approximated, by assuming the geometrical dimensions as given in the schematic drawing of FIG. 5(C). If b is the thickness of the wire length adjusting tool 14 in a longitudinal direction of the wires 11 and a is the width of the opening 29 in the same direction, then approximately:

$$L_n \approx b + 2\sqrt{\left(\frac{a-b}{2}\right)^2 + h_n^2}$$

Thus the height hn of the n-th step is approximately given by the following equation:

$$h_n \approx \sqrt{\left(\frac{L_n - b}{2}\right)^2 - \left(\frac{a-b}{2}\right)^2} = \frac{1}{2}\sqrt{L_n^2 - a^2 - 2b(L_n - a)}$$

The equation for the height hn can be even more simplified by assuming the arrangement of the wire 11 as shown in FIG. 5(C), i.e. by taking the lines for b→0:

$$h_n \approx \sqrt{\left(\frac{L_n}{2}\right)^2 - \left(\frac{a}{2}\right)^2} = \frac{1}{2}\sqrt{L_n^2 - a^2}$$

This equation may be adopted for n≧3, preferably for n≧4, since for smaller n, the deviations could be too big and thus the precision of the wire arrangement could lie below a required error standard.

Preferably the tip or extremity 15*r* of the step or recess 15 may be rounded of as shown in FIG. 5(B) as phantom line for avoiding damages to the wires 11 and for reducing even more the deviations or errors, when calculating the height hn of the steps 15 by the above simplified formula or equation (FIG. 5(C)). Moreover the edges 28*r* of the placing table means or units 28 may be rounded off (FIG. 5(B)) for avoiding damages to the wires 11 and allowing for a smooth bending thereof, when the length adjusting means 14 are inserted into the opening 29.

Furthermore the opening 29 should have such a width a, that the wires 11 are not damaged, when the wire length adjusting tool 14 is inserted thereinto, in particular for avoiding wedging or clipping of the wires 11 by the edges of the wire length adjusting tool 14 and/or damages caused by a too strong bending of the wires 11, when the gap or interstice or clearance between the edge of the placing table means or connector connecting unit 24 and the wire length adjusting means 14 is too small. In other words, the opening 29 has such a width a along the feeding direction P or longitudinal direction of the wires 11, that the wire length adjusting tool 14 can be loosely fitted or inserted into the opening 29 with the wires 11 arranged therebetween such that the wires 11 are not damaged, e.g. by wedging, buckling or too strong bending.

Figure 4:
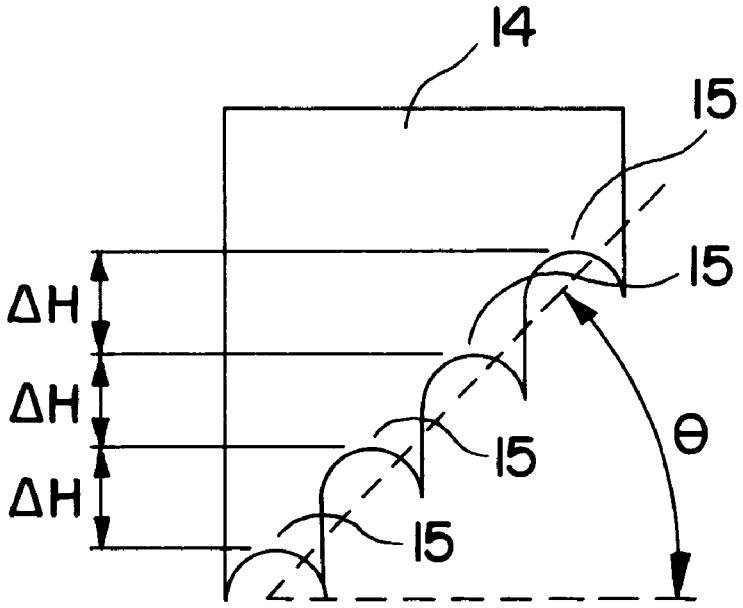
FIG. 4 is a front view of the wire length adjusting tool used to produce the wiring harness of FIGS. 1 and 2.

Furthermore the steps or recesses or bevelled portions 15 may be spaced according to the distance or pitch of the wires 11. In FIGS. 4 and 5 the distance w between the wires 11 is equal for all the wires 11 and thus the corresponding steps 15 are equally spaced from each other. In case the wires are not equally spaced (not shown), the steps 15 are correspondingly also not equally spaced. In other words, the steps or recesses or bevelled portions 15 are formed in correspondence to the positions of the respective wires 11 to be displaced. Preferably the wire length adjusting tool 14 is produced or formed having an inclined side, into which recesses 15 are formed in accordance with the corresponding position of the wires 11 to be displaced.

As shown in FIG. 5, the circuit length adjusting unit 29 is constructed such that an opening 30 for loosening the wires 11 by allowing the wire length adjusting tool 14 to be pushed down is formed in a center portion of the upper surface of the wire arrangement table 24. The opening 30 has such a width along the feeding direction P, that the wire length adjusting tool 14 can loosely fit in the opening 30 with the wires 11 arranged therebetween such that the wires 11 are not damaged e.g. by wedging or buckling or too strong bending. Although the connector connecting unit 26, the connector fixing unit 27, the wire lifting unit 28 and the circuit length adjusting units 29 are arranged on the long wire arrangement table 24 in this embodiment, the wire arrangement table 24 may be made up of divided wire arrangement tables provided for the respective individual units such that the spacings between the respective divided wire arrangement tables are adjustable.

Two connectors 25 can be set along the feeding direction P in the connector connecting unit 26. The unit 26 includes pressing devices 26*a* for pressingly connecting the respective wires 11 with the respective connectors 25 and wire cutters 26*b* for cutting the wires 11 between the connection positions of the connectors 25.

In this embodiment, two circuit length adjusting units 29 are provided in different positions.

The wire lifting device 28*a* may, for example, be constructed by a support frame movable upward and downward and a roller which is formed with U- or V-shaped grooves in positions corresponding to the wires 11 and is rollably supported on the support frame. Alternatively, the wire lifting device 28*a* may include a plurality of rollers independently provided for the respective wires 11 or a fixed bar provided with grooves having a reduced friction coefficient.

Next, there is described a wiring harness producing method according to a first embodiment of the invention using the above apparatus.

Figure 7:
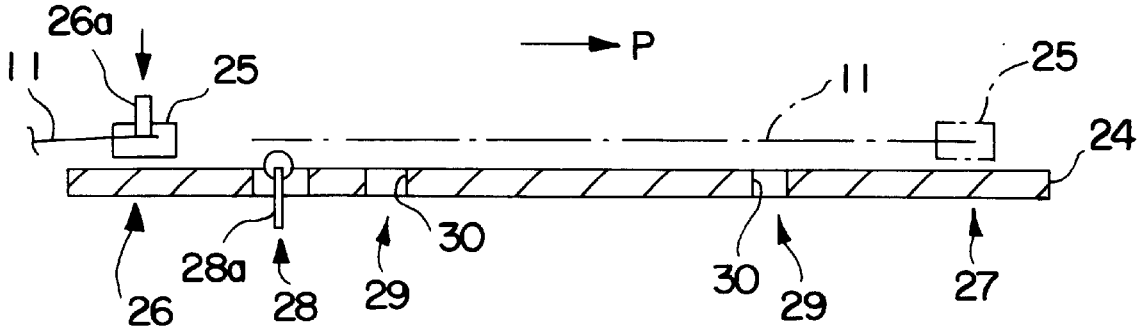
FIG. 7 is a diagram showing a wiring harness production process according to a first embodiment of the invention.

First, as shown in FIG. 7, a specified connector 25 is set in the connector connecting unit 26. The wires 11 are fed from a plurality of wire feeding drums 20 of the wire feeding unit 21, and are guided to specified positions of the set connector 25 while the spacings or pitches between the wires 11 are set by passing the wires 11 through the grooves 22*a* of the wire aligning device 22 of the wire aligning unit 23, wherein the spacings are preferably equal, at least within a predetermined tolerance. The wires 11 are pressed into contact with the corresponding insulation cutting portions of the connector 25 by the pressing device 26*a* (wire connecting step).

Subsequently, the connector 25 connected with the respective wires 11 is moved to and fixed by the connector fixing unit 27 located at the downstream side with respect to the feeding direction P as indicated by phantom line in FIG. 7. Accordingly, the wires 11 substantially linearly extend in substantially parallel with each other from the upstream side to the downward side along the feeding direction P on the upper surface of the wire arrangement table 24 (connector moving/fixing step).

Figure 8:
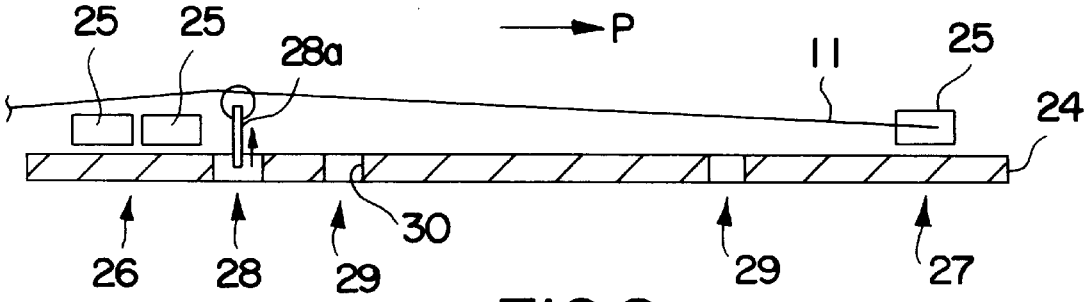
FIG. 8 is a diagram showing the wiring harness production process according to a first embodiment of the invention.

Thereafter, as shown in FIG. 8, the wire lifting device 28*a* of the wire lifting unit 28 is pushed up to lift the wires 11 (wire lifting step).

While or after the wires 11 are lifted, two new connectors 25 are set in parallel with each other in the connector connecting unit 26 (connector setting step). At this time, the downstream one of the newly set connectors 25 is paired with the connector 25 fixed in the connector fixing unit 27, whereas the upstream one thereof is used for a wiring harness produced next.

Figure 9:
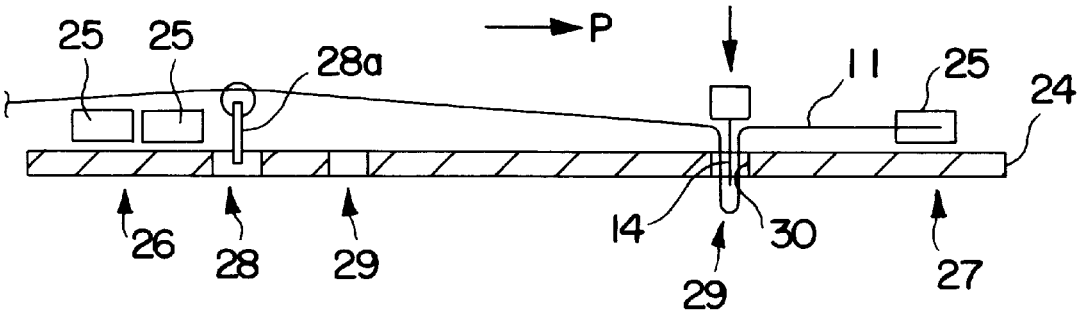
FIG. 9 is a diagram showing the wiring harness production process according to a first embodiment of the invention.
Figure 10:
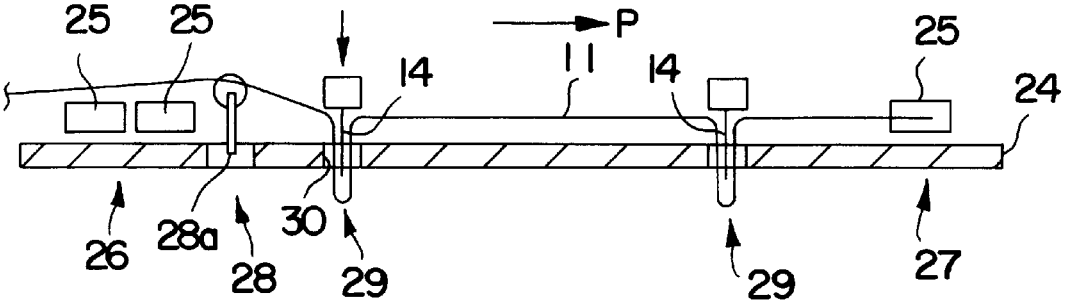
FIG. 10 is a diagram showing the wiring harness production process according to a first embodiment of the invention.

Next, as shown in FIGS. 5, 9 and 10, the steps 15 of the wire length adjusting tool 14 are brought into contact with the respective wires 11 (11*a* to 11*d*) extending across the opening 30 of the wire arrangement table 24, and are pushed down by a specified distance to loosen the wires 11*a* to 11*d* by lengths corresponding to the heights of the steps 15 (circuit length adjusting step). At this time, the wires 11 are fed from the respective wire feeding drums 20 by the loosened lengths.

This circuit length adjustments for setting the different loosened lengths for the respective wires 11 by the wire length adjusting tool 14 may be performed more than one time and are preferably successively made from the downward located circuit length adjusting unit 29.

The wire length adjusting tool 14 may automatically be pushed down using an electrically or electronically controlled elevating device or manually pushed down by an operator.

Figure 11:
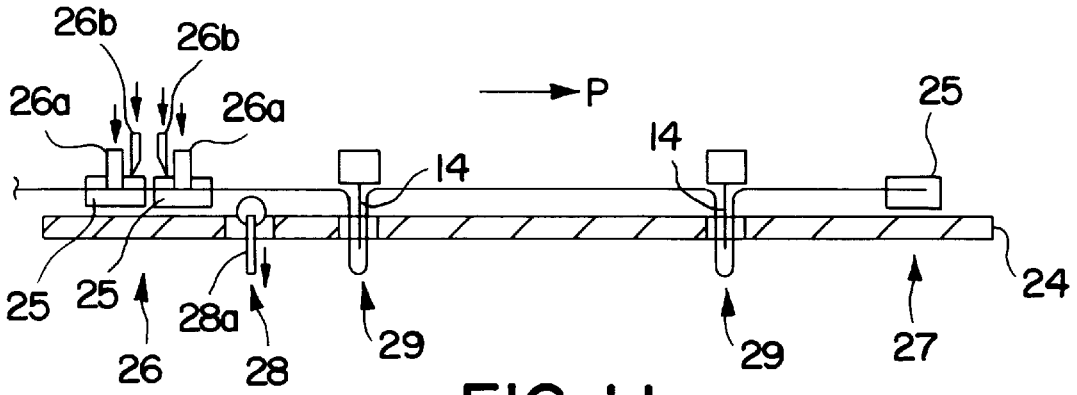
FIG. 11 is a diagram showing the wiring harness production process according to a first embodiment of the invention.

Next, as shown in FIG. 11, the wire lifting device 28*a* is lowered, thereby lowering the respective wires 11. The wires 11 are then aligned on the insulation cutting portions of the respective connectors 25 set in the connector connecting unit 26. Thereafter, the pressing devices 26*a* corresponding to the respective connectors 25 are lowered to press the wires 11 into the insulation cutting portions of the connectors 25. Subsequently or simultaneously, the wire cutters 26*b* corresponding to the connectors 25 are lowered to cut the wires 11 between the connection positions of the connectors 25 (connecting/cutting step). At this stage, the wiring harnesses located at the downstream and upstream sides along the feeding direction P are separated from each other.

Figure 12:
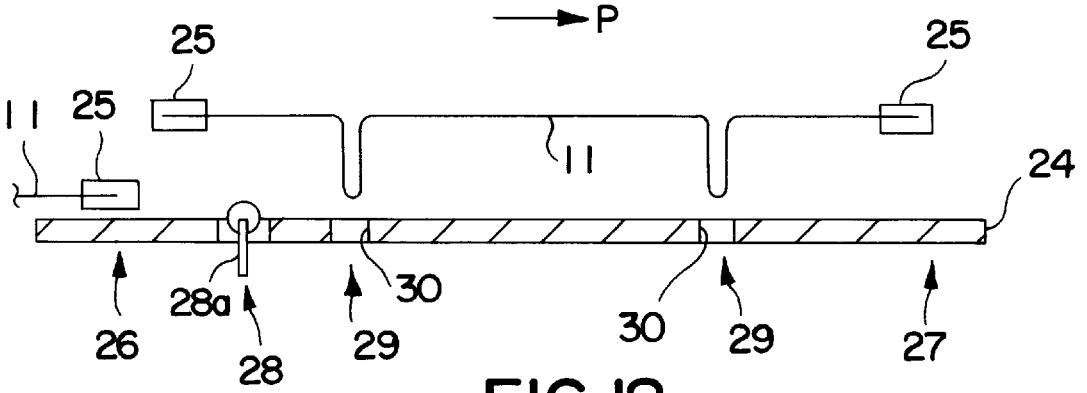
FIG. 12 is a diagram showing the wiring harness production process according to a first embodiment of the invention.

Thereafter, as shown in FIG. 12, the downstream wiring harness having its circuit length adjusted and having the connectors 25 connected with its ends is collected or picked up from the wire arrangement table 24 (wire collecting step). The portions of the wires arranged in parallel on the wire arrangement table 24, i.e. between the connector(s) and the opening 30 or between the two or more openings 30 may be fixed by the insulation tapes 12 or the like fixing means (as clamps, clips, soldering, gluing, etc.) during or after the collection of the wiring harness.

One connector 25 connected with the wires 11 is still left in the connector connecting unit 26. By repeating a sequence of steps after the connector moving/fixing step, wiring harnesses having circuit length differences necessary to mount the wiring harnesses in a curved manner are successively assembled.

Figure 13:
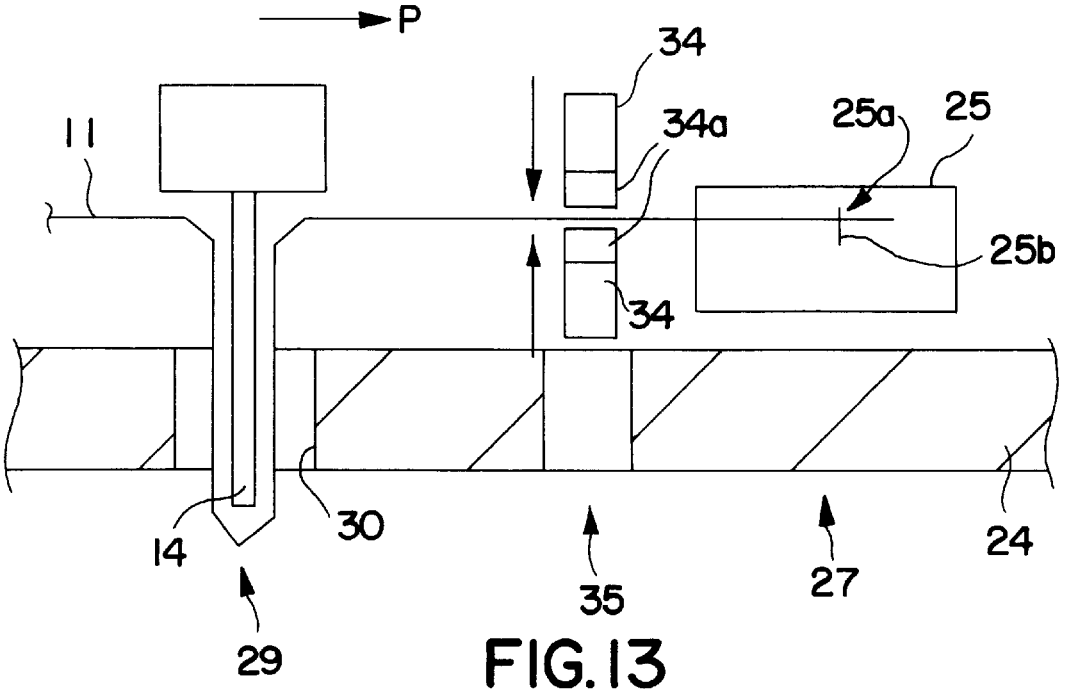
FIG. 13 is a diagram showing an essential portion of another embodiment according to a first embodiment of the invention.

Further, as shown in FIG. 13, there may also be provided a wire fixing unit 35 downstream from the downstream side circuit length adjusting unit 29 and slightly upstream from the connector fixing unit 27. The wire fixing unit 35 includes wire fixing devices 34 for releasably holding the wires 11 from opposite sides along the substantially vertical direction, in particular to releasably position the wires in a predetermined or predeterminable position along the feeding direction P and/or a direction substantially perpendicular thereto.

In such a case, the circuit length adjusting step may be performed while the wires 11 after the connector moving/fixing step, the wire lifting step or the connector setting step are fixed by the wire fixing devices 34 (wire fixing step).

The loosened lengths of the respective wires 11 are set by pushing down the wire length adjusting tool 14 in the circuit length adjusting step. At this time, tensions individually act on the wires 11. Accordingly, if these tensions act on wire connecting portions 25*a* of the connector 25 fixed by the connector fixing unit 27, these forces act to pull out the conductors of the wires 11 having pressed into the insulation cutting portions 25, leading to a degraded connection stability.

However, if the wires 11 are fixed before the circuit length adjusting step, since the wires 11 are fixed by the wire fixing devices 34, the tensions which would act on the wires 11 during the circuit length adjustment do not act on the wire connecting portions 25*a* of the connector 25 fixed by the connector fixing unit 27. Accordingly, a satisfactory connection stability can be ensured.

It is preferable in view of damage prevention to mount a member made of a flexible material such as a rubber elastomer on an opposite portion 34*a* of each wire fixing devices 34 for fixingly holding the wires 11. Such a member may be a metal or plastic integral part having a bevelled end portion.

The fixation of the wires 11 by the wire fixing units 34 is preferably released after the circuit length adjusting step.

Figure 14:
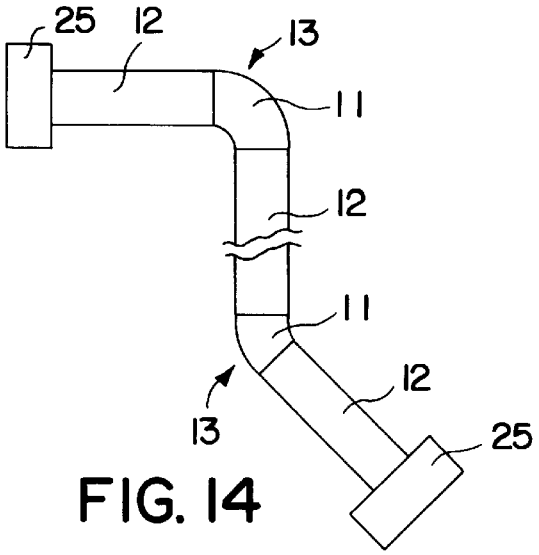
FIG. 14 is a plan view of another example of a wiring harness produced according to the embodiment of the invention.
Figure 15:
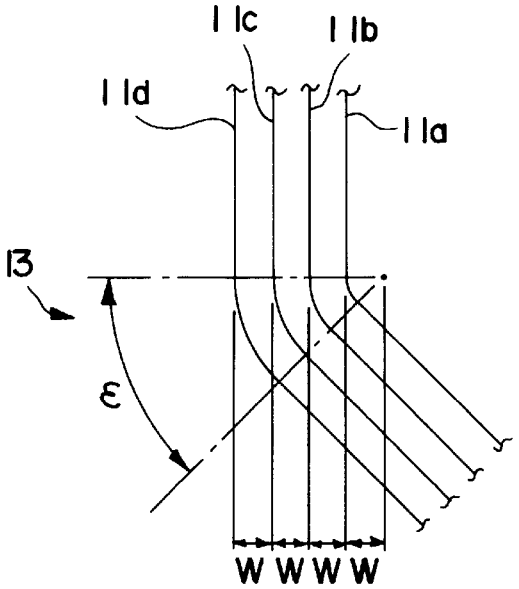
FIG. 15 is a diagram of a curved portion of the wiring harness of FIG. 14 in which the respective wires are bent at 45°.

In the case that the longitudinal direction of the wires 11 needs to be bent at an angle $\epsilon$ of, e.g. 45° in the curved portion 13 as shown in FIGS. 14 and 15, the height ($\Delta H$) of the steps 15 of the wire length adjusting tool 14 may be so set as to correspond or conform to the difference in length between the wires 11 as follows. If the spacing between the wires 11 is w and the radii of curvature of the wires 11 are w, 2w, 3w, 4w, respectively, lengths L1, L2, L3, L4 of the wires 11*a* to 11*d* in the curved portion 13 are each one eighth of a circumference of a circle defined by the corresponding radius of curvature:

$$L1=(2\pi\cdot w)/8=\pi w/4$$

$$L2=(2\pi\cdot 2w)/8=\pi w/2$$

$$L3=(2\pi\cdot 3w)/8=3\pi w/4$$

$$L4=(2\pi\cdot 4w)/8=\pi w.$$

In general the length is given by the formula $Li=(2\pi\cdot i\cdot w)\cdot\epsilon[°]/360°$, wherein $\epsilon$ is the angle of bent or curvature of the wires 11 (FIG. 2).

Differences in length between the neighboring wires are:

$$L2-L1=(\pi w/2)-(\pi w/4)=\pi w/4$$

$$L3-L2=(3\pi w/4)-(\pi w/2)=\pi w/4$$

$$L4-L3=(\pi w)-(3\pi w/4)=\pi w/4.$$

Figure 16:
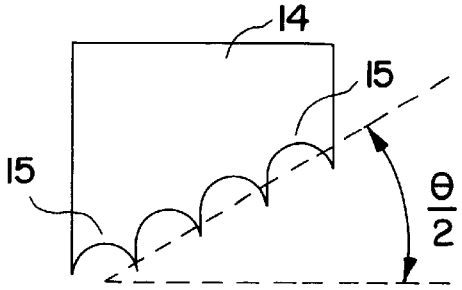
FIG. 16 is a front view of a wire length adjusting tool used to produce the wiring harness of FIGS. 14 and 15.

Specifically, if the inclination of the steps 15 of the wire length adjusting tool 14 is $\theta$ (see FIG. 4) when a bending angle $\epsilon$ of the wires 11 at the curved portion 13 is 90°, the inclination of the steps of the wire length adjusting tool 14 is set to $\theta/2$ as shown in FIG. 15 when the bending angle $\epsilon$ of the wires 11 is 45° as shown in FIG. 16. In general, the inclination of the steps 15 of the wire length adjusting tool 14 with respect to the bending angle $\epsilon$ of the wires 11 may be set at ($\theta \times \epsilon/90°$). The inclination $\theta$ of the steps or recesses 15 of the wire length adjusting tool 14 may be set constant only for the steps 15 corresponding to those wires 11 being sufficiently spaced from the center of curvature, i.e. for those wires having a sufficiently big Ln that is for n sufficiently big, preferably for $n \geqq 4$. However also a variable $\theta$ is possible.

In general the respective length of the n-th wire for a bending angle $\epsilon$ of the wires and for a distance between the wires 11 of w is given by the following equation (assuming that the wires are bent along a n arc of a circumference):

$$L_n \approx 2\pi nw = \frac{\varepsilon[°]}{360°}$$

so that the length difference between adjacent wires generally is:

$$\Delta L = L_n - L_{n-1} = 2\pi w = \frac{\varepsilon[°]}{360°}$$

In case the bent portions 13 of the wires 11 do not follow an arc of a circumference the above equations apply only as an approximation, however the invention is not limited thereto. The inclination $\theta$ of the steps 15 may be constant for n sufficiently big, e.g. $n \geqq 4$.

As described above, only by performing a very easy action of pushing the wire length adjusting tool 14 having the steps 15 at an angle different from 0° or 180°, preferably substantially straight down with respect to the wires 11*a* to 11*d* after substantially linearly arranging the wires 11*a* to 11*d*, the wires 11*a* to 11*d* can be adjusted in length by being loosened by the lengths suited to forming the curved portion 13. Accordingly, the wires 11*a* to 11*d* can be arranged within a short period of time without requiring a work space and without being folded as in the third prior art.

In the case that a wiring harness has three or more curved portions 13, the number of the circuit length adjusting units 29 may be increased so as to conform to the number of the curved portions 13. Further, if the distance between the curved portions 13 is changed in the case that there are a plurality of curved portions 13, the distances between the connector connecting device 26, the circuit length adjusting devices 29 and the connector fixing unit 27 may suitably be changed according to the purpose.

Although the wires 11 having being loosened by specified lengths to form the curved portions 13 are arranged on the same plane in FIG. 1, they may be arranged while being curved in a three-dimensional manner.

A second embodiment of the invention will be described with reference to FIGS. 17 to 27, wherein same reference signs denote same or similar elements.

In this wiring harness, a plurality of wires 11 are arranged substantially in parallel at substantially even intervals on the same plane, and are secured to each other by being partly held between two insulation tapes 12 as connecting sheet members for fixing the wires or by adhering the insulation tapes 12 from one side. Particularly, in order to conform to a complicated wiring path having curved portions, all wires 11 are curved along substantially concentric arcs at substantially even intervals in each curved portion 13.

The insulation tapes 12 act to hold the respective wires 11 straight at even intervals.

In this case, the respective wires 11 are insulated wires coated with an insulation material such as polyvinyl chloride or polyethylene, and the insulation tapes 12 are resin films made of, e.g. polyethylene, polypropylene, polyimide or vinyl chloride. Further, for the adhesion of the wires 11 and the insulation tapes 12, there is used a thermoplastic adhesive based on a natural, synthetic or butyl rubber, a vinyl acetate thermoplastic adhesive, a polyvinyl acetal thermoplastic adhesive, an acrylic thermoplastic adhesive or a vinyl acetate thermoplastic adhesive (may be an adhesive which exhibits adhesiveness at room temperature). If necessary, an instantaneous adhesive of cyanoacrylate or an ultraviolet curing adhesive may be used. Alternatively clamps, clips or the like fastening means may be used instead of or additionally to the insulation tapes 12.

This embodiment comprises one or more sheet member adhering units 31 for adhering the insulation tape 12 over the linearly and parallelly arranged portions of the respective wires 11, which are provided between the connector connecting unit 26 and the upstream side circuit length adjusting unit 29, between the circuit length adjusting units 29, and between the downstream side circuit length adjusting unit 29 and the connector fixing unit 27.

Figure 26A:
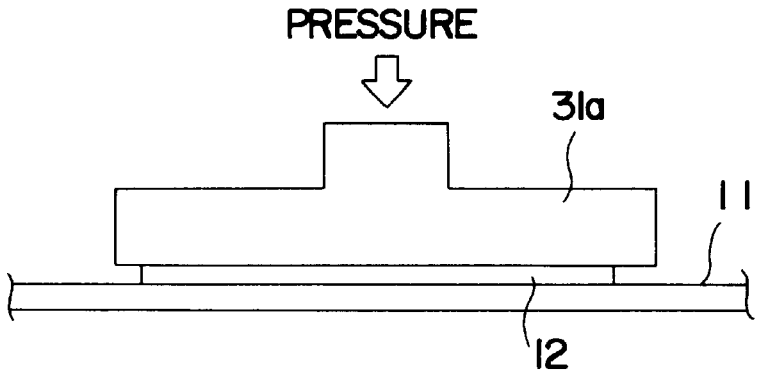
FIG. 26(A) is a diagram of an example of a sheet member adhering unit according to a further preferred embodiment of the invention.
Figure 26B:
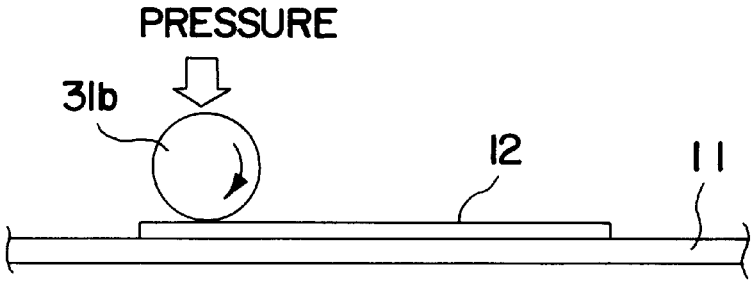
FIG. 26(B) is a diagram of another example of the sheet member adhering unit according to a further preferred embodiment of the invention.

The sheet member adhering unit 31 may preferably be constructed as shown in FIGS. 26 and 27 in the case that the insulation tapes 12 are adhered using a thermoplastic adhesive. Specifically, the insulation tape 12 to which the thermoplastic adhesive is applied is placed over the wires 11, and is pressed by a pressing plate 31*a* having a shape conforming to an insulation tape adhering area and heated to a melting temperature of the adhesive so as to be adhered to the wires 11 (FIG. 26(A)). Alternatively, the insulation tape 12 to which the thermoplastic adhesive is applied is placed over the wires 11, and is pressingly adhered to the wires 11 by rolling a pressing roller 31*b* heated to a melting temperature of the adhesive in a specified direction (FIG. 26(B)).

Although FIGS. 26(A) and 26(B) show the constructions in which the pressing plate 31*a* and the pressing roller 31*b* are arranged only at the side of the insulation tape 12, the pressing plates 31*a* and the pressing rollers 31*b* may be so arranged as to hold the insulation tape 12 and the wires 11 therebetween. Further, the insulation tapes 12 may be provided at the opposite sides of the wires 11 and adhered to the wires 11 from opposite sides along the vertical direction.

Next, there is described a wiring harness producing method using the above apparatus.

Figure 17:
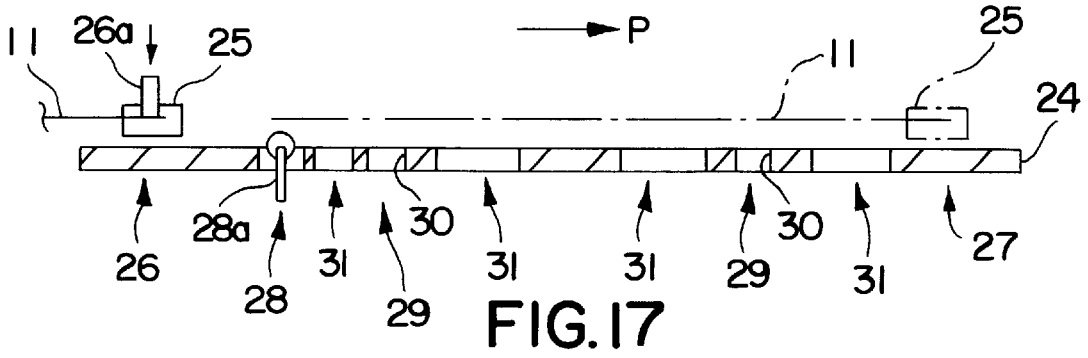
FIG. 17 is a diagram showing a wiring harness production process according to a second embodiment of the invention.

First, as shown in FIG. 17, a specified connector 25 is set in the connector connecting unit 26. The wires 11 are fed from a plurality of wire feeding drums 20 of the wire feeding unit 21, and are guided to specified positions of the set connector 25 while the spacings between the wires 11 are set by passing the wires 11 through the grooves 22*a* of the wire aligning device 22 of the wire aligning unit 23. The wires 11 are pressed into contact with the corresponding insulation cutting portions of the connector 25 by the pressing device 26*a* (wire connecting step).

Subsequently, the connector 25 connected with the respective wires 11 is moved to and fixed by the connector fixing unit 27 located at the downstream side with respect to the feeding direction P as indicated by phantom line in FIG. 17. Accordingly, the wires 11 linearly extend in parallel with each other from the upstream side to the downward side along the feeding direction P on the upper surface of the wire arrangement table 24 (connector moving/fixing step).

Figure 18:
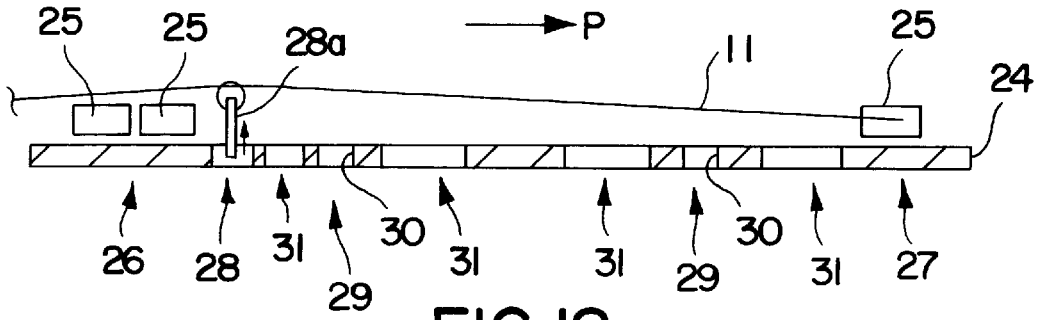
FIG. 18 is a diagram showing the wiring harness production process according to a second embodiment of the invention.

Thereafter, as shown in FIG. 18, the wire lifting device 28*a* of the wire lifting unit 28 is pushed up to lift the wires 11 (wire lifting step).

While the wires 11 are lifted, two new connectors 25 are set in parallel with each other in the connector connecting unit 26 (connector setting step). At this time, the downstream one of the newly set connectors 25 is paired with the connector 25 fixed in the connector fixing unit 27, whereas the upstream one thereof is used for a wiring harness produced next.

Figure 19:
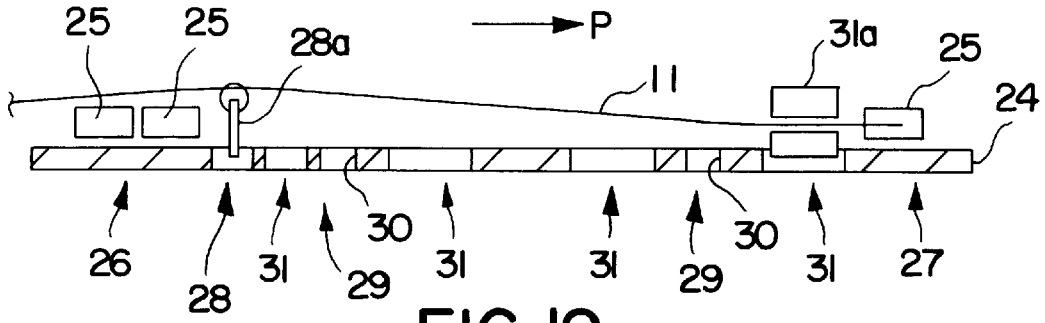
FIG. 19 is a diagram showing the wiring harness production process according to a second embodiment of the invention.

Subsequently, as shown in FIG. 19, the most downstream sheet member adhering unit 31 adheres the insulation tape 12 to the linearly and parallelly arranged portions of the wires 11 between the connector fixing unit 27 and the downstream circuit length adjusting unit 29, thereby fixing the wires 11 to each other (downstream side sheet member adhering step).

Figure 20:
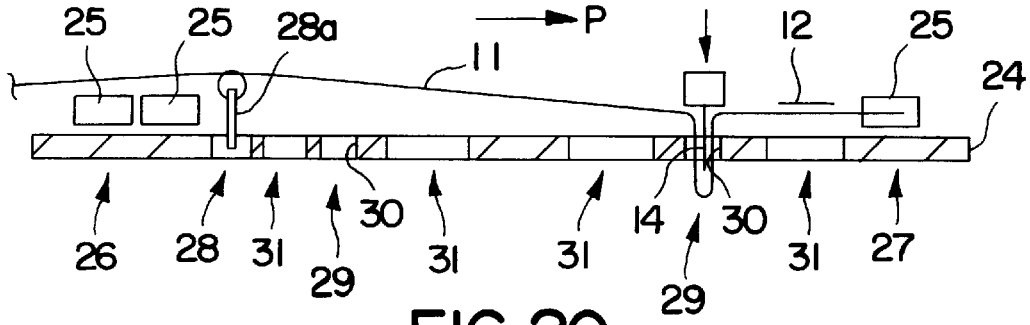
FIG. 20 is a diagram showing the wiring harness production process according to a second embodiment of the invention.

Next, as shown in FIG. 20, in the downstream circuit length adjusting unit 29, the steps 15 of the wire length adjusting tool 14 are brought into contact with the respective wires 11 (11*a* to 11*d*) extending across the opening 30 of the wire arrangement table 24, and are pushed down by a specified distance to loosen the wires 11*a* to 11*d* by lengths corresponding to the heights of the steps 15 (circuit length adjusting step). At this time, the wires 11 are fed from the respective wire feeding drums 20 by the loosened lengths. In this way, the different loosened lengths are set for the respective wires 11.

The wire length adjusting tool 14 may automatically be pushed down using an electrically controlled elevating device or manually pushed down by an operator.

Figure 21:
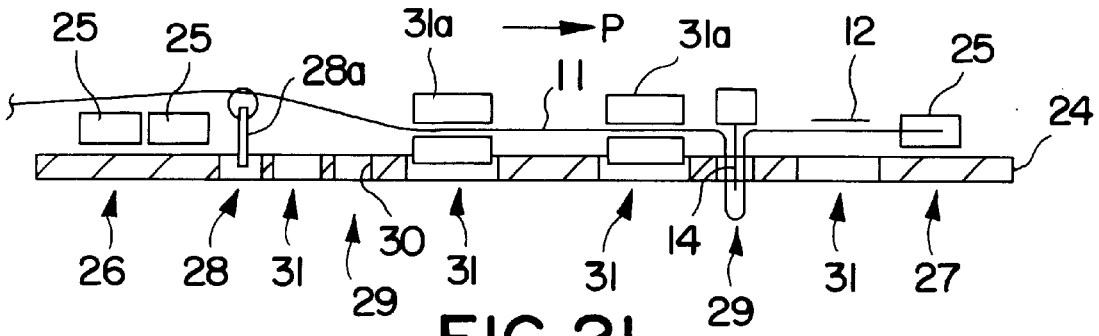
FIG. 21 is a diagram showing the wiring harness production process according to a second embodiment of the invention.
Figure 22:
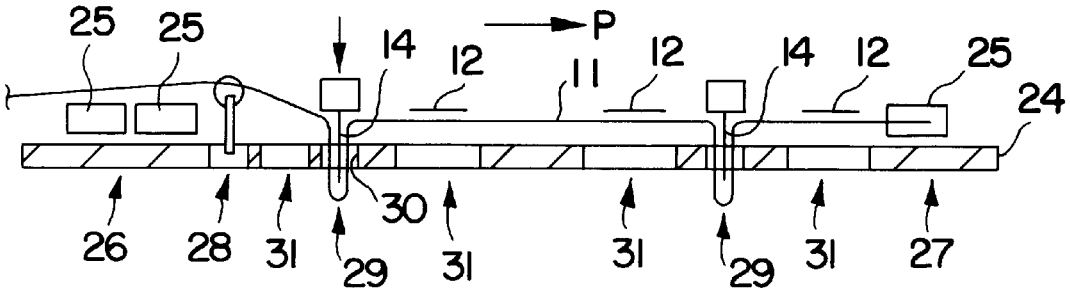
FIG. 22 is a diagram showing the wiring harness production process according to a second embodiment of the invention.

Subsequently, as shown in FIG. 21, the second most downstream sheet member adhering unit 31 adheres the insulation tape 12 to the linearly and parallelly arranged portions of the wires 11 between the downstream circuit length adjusting unit 29 having performed a circuit length adjustment and the upstream circuit length adjusting unit 29 having not yet performed a circuit length adjustment, thereby fixing the wires 11 to each other (downstream side sheet member adhering step).

Next, as shown in FIG. 20, in the upstream circuit length adjusting unit 29, the steps 15 of the wire length adjusting tool 14 are brought into contact with the respective wires 11 (11*a* to 11*d*) extending across the opening 30 of the wire arrangement table 24, and are pushed down by a specified distance to loosen the wires 11*a* to 11*d* by lengths corresponding to the heights of the steps 15 (circuit length adjusting step).

Figure 23:
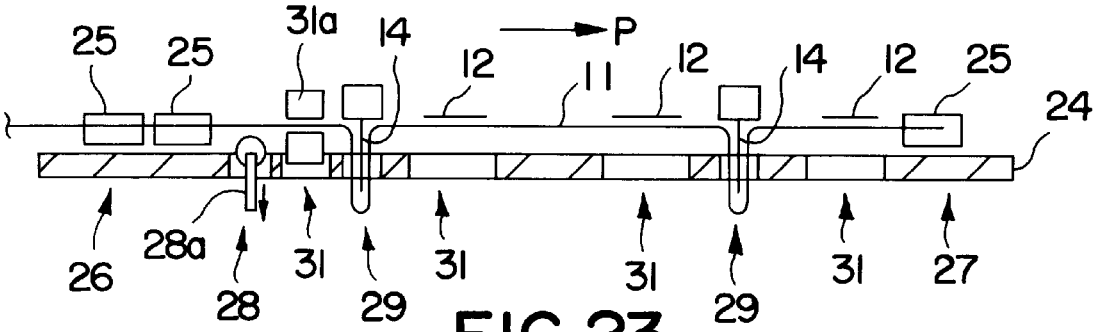
FIG. 23 is a diagram showing the wiring harness production process according to a second embodiment of the invention.

Next, as shown in FIG. 23, the wire lifting device 28*a* is lowered, thereby lowering the respective wires 11. The wires 11 are then aligned on the insulation cutting portions of the respective connectors 25 set in the connector connecting unit 26 (wire lowering step).

Thereafter, the second most upstream sheet member adhering unit 31 adheres the insulation tape 12 to the linearly and parallelly arranged portions of the wires 11 between the upstream circuit length adjusting unit 29 having performed a circuit length adjustment and wire lifting unit 28, thereby fixing the wires 11 to each other (upstream side sheet member adhering step).

Figure 24:
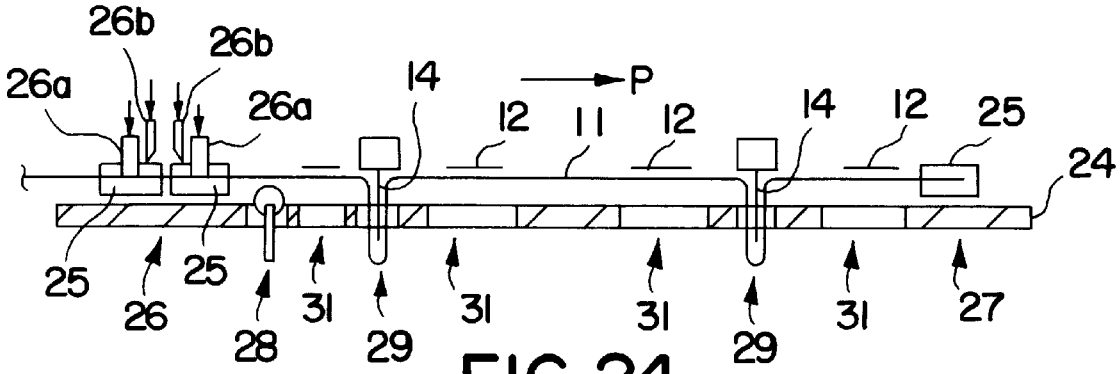
FIG. 24 is a diagram showing the wiring harness production process according to a second embodiment of the invention.

Next, as shown in FIG. 24, the pressing devices 26*a* corresponding to the respective connectors 25 are lowered to press the wires 11 into the insulation cutting portions of the connectors 25. Subsequently or simultaneously, the wire cutters 26*b* corresponding to the connectors 25 are lowered to cut the wires 11 between the connection positions of the connectors 25 (connecting/cutting step). At this stage, the wiring harnesses located at the downstream and upstream sides along the feeding direction P are separated from each other.

Figure 25:
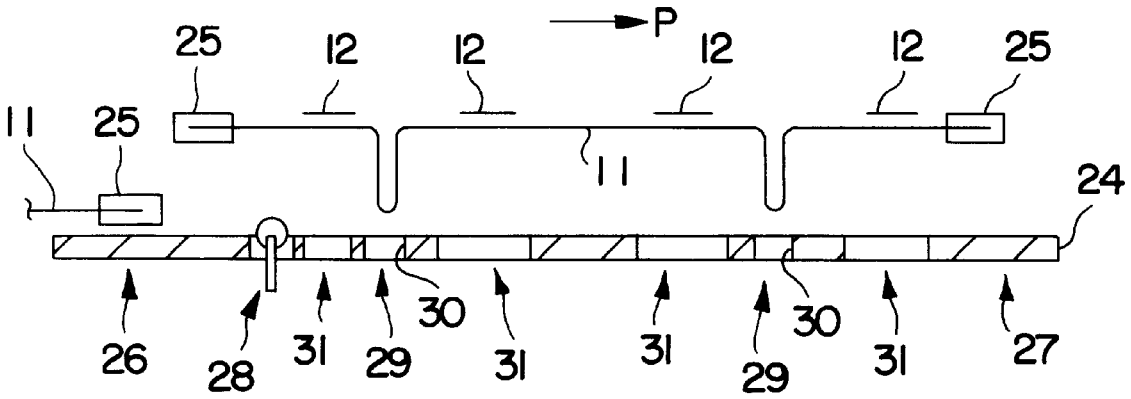
FIG. 25 is a diagram showing the wiring harness production process according to a second embodiment of the invention.

Thereafter, as shown in FIG. 25, the downstream wiring harness having its circuit length adjusted and having the connectors 25 connected with its ends is collected from the wire arrangement table 24 (wire collecting step).

One connector 25 connected with the wires 11 is still left in the connector connecting unit 26. By repeating a sequence of steps after the connector moving/fixing step, wiring harnesses having circuit length differences necessary to mount the wiring harnesses in a curved manner are successively assembled.

Figure 28:
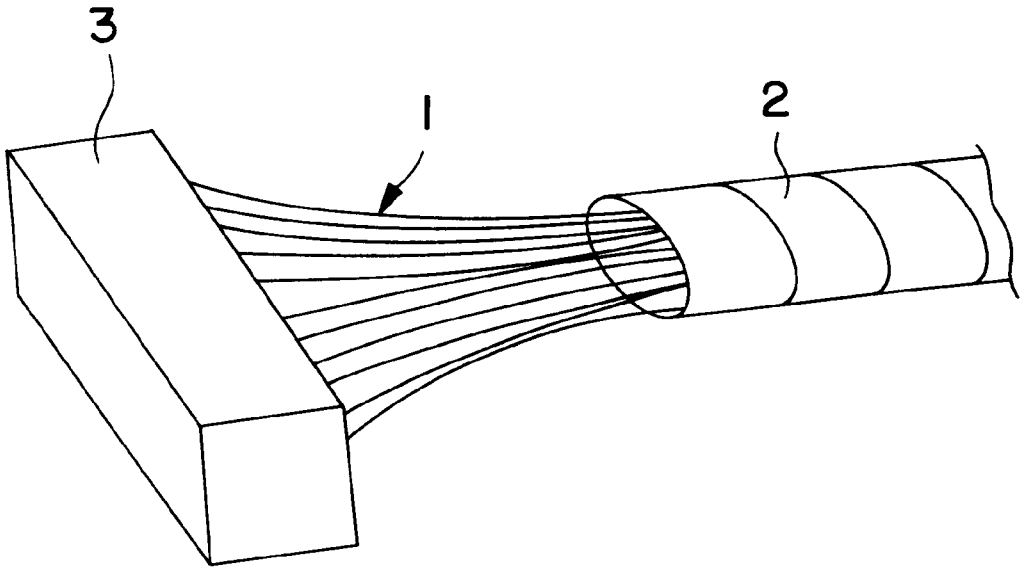
FIG.28 PRIOR ART
FIG. 28 is a perspective view of a wiring harness for electrical connection according to first prior art.
Figure 29:
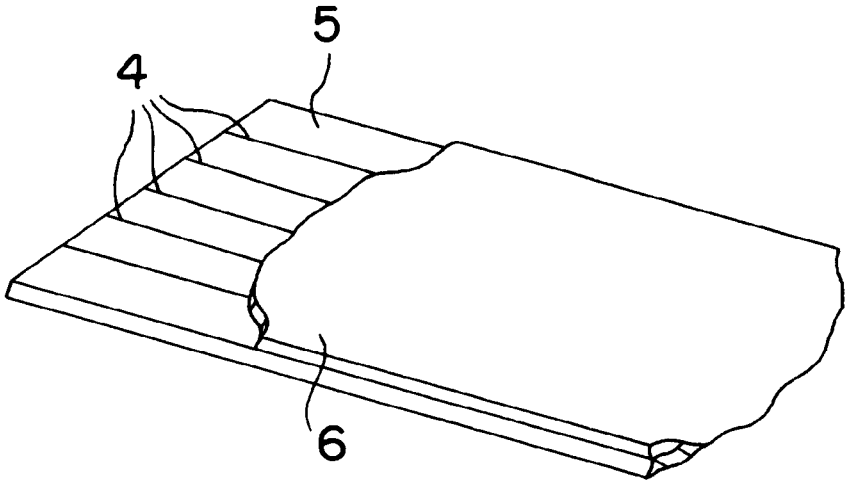
FIG.29 PRIOR ART
FIG. 29 is a perspective view partly in section of a wiring harness for electrical connection according to second prior art.
Figure 30:
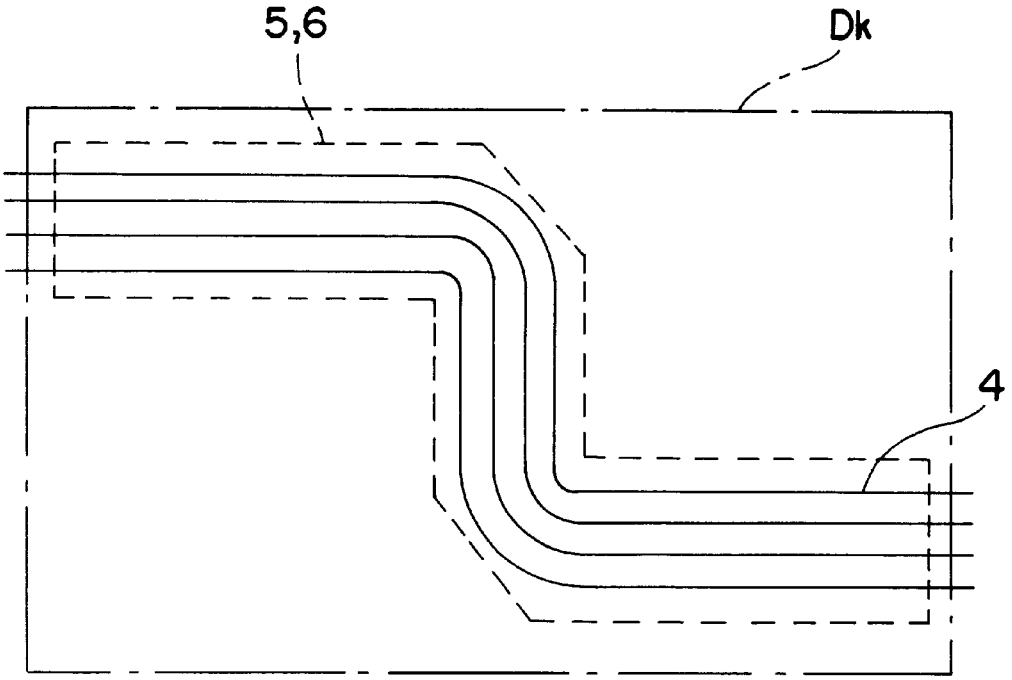
FIG. 30 PRIOR ART
FIG. 30 is a plan view showing a production process of the wiring harness according to the second prior art.
Figure 31:
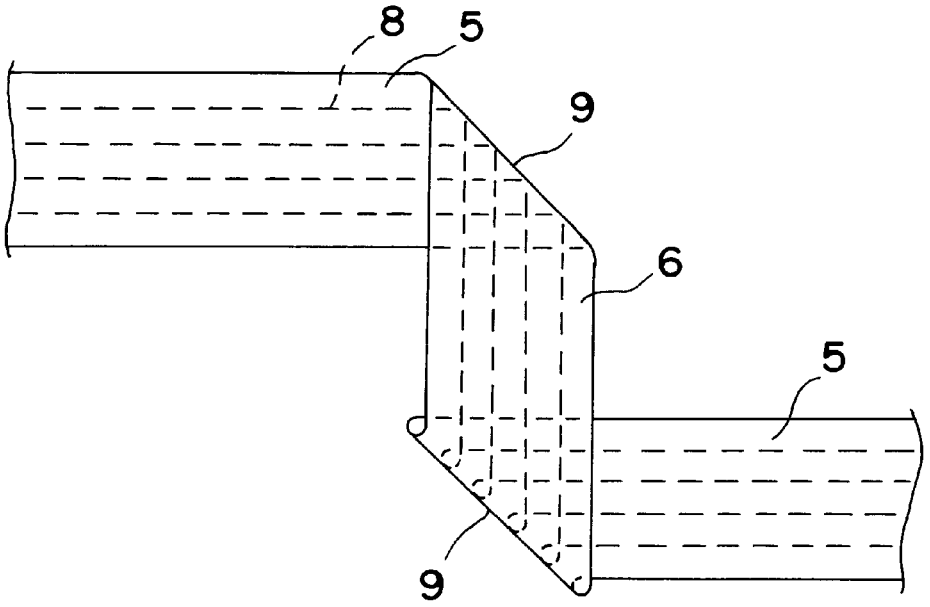
FIG. 31 PRIOR ART
FIG. 31 is a diagram of a folded wiring harness according to third prior art.
Figure 32:
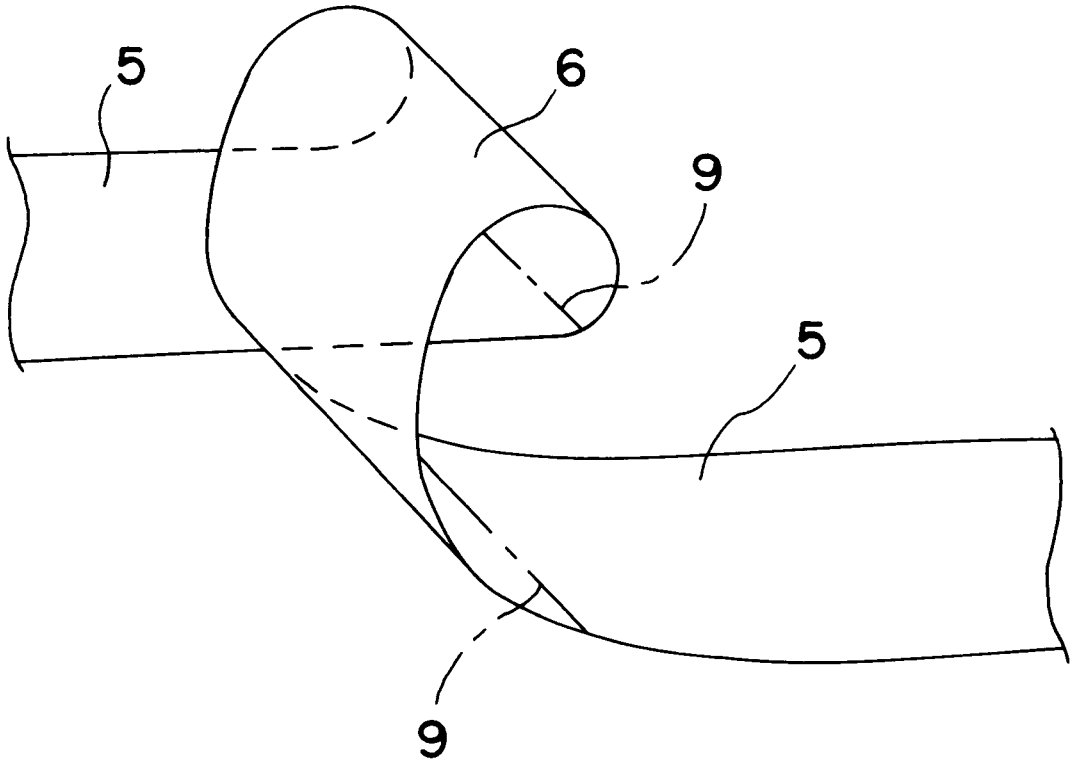
FIG.32 PRIOR ART
FIG. 32 is a diagram showing the wiring harness of FIG. 20 in which folded portions are elastically restored.

Further, as shown in FIG. 28, there is also provided a wire fixing unit 35 between the connector fixing unit 27 and the downstream circuit length adjusting unit 29, i.e. between the sheet member adhering unit 31 and the downstream circuit length adjusting unit 29 in this embodiment. The wire fixing unit 35 includes wire fixing devices 34 for releasably holding the wires 11 from opposite sides along the vertical direction.

The wire fixing unit 35 may be provided between the sheet member adhering unit 31 slightly upstream from the connector fixing unit 27 and the connector fixing unit 27.

Although the insulation tapes 12 are used as connecting sheet members in the shown embodiment, harder resin insulation plates may instead be used to render the wiring harness a shape maintaining characteristic.

Figure 27A:
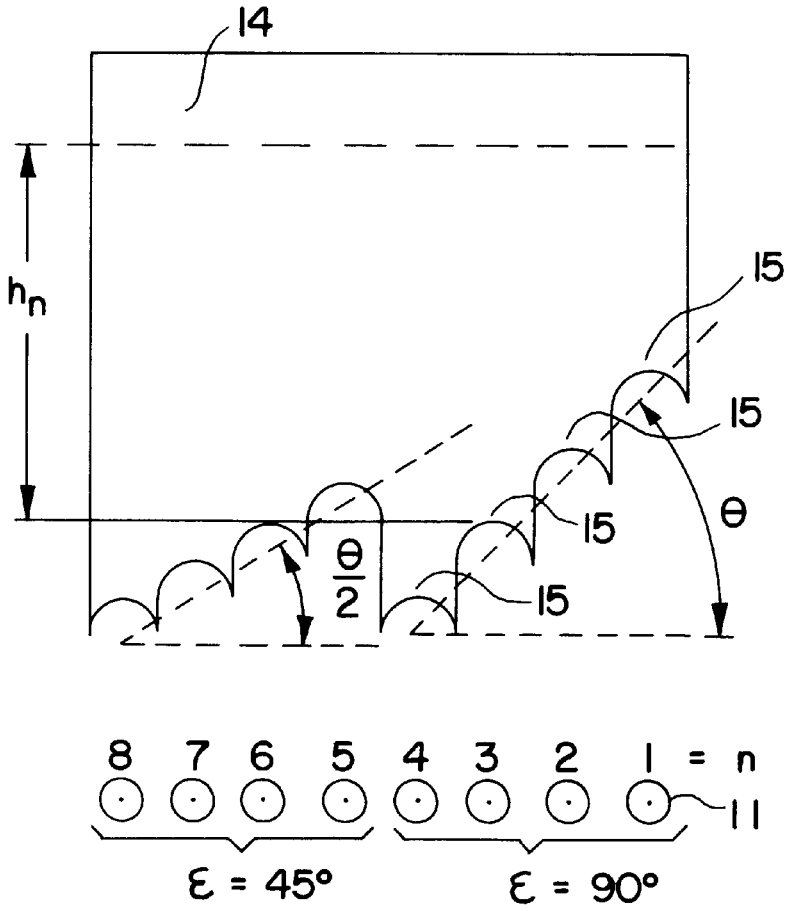
FIG. 27(A) is a front view of a tool used to produce the wiring harness of FIG. 27(B).
Figure 27B:
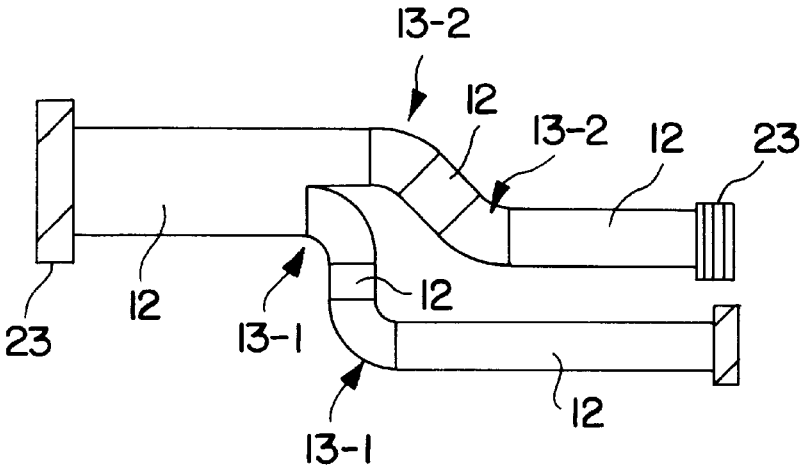
FIG. 27(B) a plan view of a wiring harness having differently bent bent portions, which is produced by a producing apparatus according to a further another embodiment of the invention.

Next a further preferred embodiment will be described with reference to FIG. 27. As can be seen from FIG. 27(B) the wire harness may have several branches being differently oriented e.g. by having different bent portions 13-1 and 13-2 having different angles (90° for the lower branch of FIG. 27(B) and 45° for the upper branch in FIG. 27(B)). These different bent portions 13-1 and 13-2 may be obtained by using the wire length adjusting tool 14 of FIG. 27(A). In this wire length adjusting tool 14 the steps or recesses 15 corresponding to the wires 11 (n=1 . . . 4) have an inclination of θ (yielding an angle ϵ=90°), while the steps 15 corresponding to the wires 11 (n=5 . . . 8) have an inclination of θ/2 (yielding an angle ϵ=45°). The lengths of the wires n=1 . . . 4 are Ln=π n w/2 and for n=5 . . . 8 Ln=π n w/4. Thus the heights h3 and h6 of the steps corresponding to the wires n=3 and n=6, respectively are the same.

The wire harness may comprise (not shown) also bent portions 13-1 and 13-2 having bendings in opposite directions, e.g. bent portions being bent downward and upward, wherein the angles ϵ-1 and ϵ-2 of the bent portions 13-1 and 13-2, respectively may be equal or not (e.g. ϵ-1=90° and ϵ-2=45°).

According to a further preferred embodiment (not shown) the wire length adjusting tool 14 may be arranged at an angle substantially different from 90° with respect to the longitudinal direction of the wires 11, so that the loosened portions of the wires 11 are not arranged on a line transverse to the direction, but shifted or spaced from each other with respect to the longitudinal direction of the wires. This embodiment allows for bent portions 13 of the wires 11 having different starting points, i.e. the bent portions 13 begin at longitudinally shifted positions with respect to each other, by using one single wire length adjusting tool 14. However, in case the bent portions 13 should start at equal positions the wire length adjusting tool 14 may be arranged substantially transverse (i.e. at 90°) with respect to the longitudinal direction of the wires 11 (or of the wire portions to be bent).

What is claimed is:

1. An apparatus for producing a flat wiring harness, said flat wiring harness comprising a plurality of substantially parallel wires arranged in a plane and aligned to define at least one curve of said substantially parallel wires in said plane, said curve defining a radially inner most wire, a radially outer most wire parallel to said radially inner most wire through said curve and at least one intermediate wire disposed substantially parallel to and between the inner most and outer most wires through said curve, said apparatus comprising:

a wire feeding unit for feeding the plurality of wires along a wire feeding direction from a plurality of wire supplies, a wire arrangement table for substantially linearly arranging the plurality of wires, the wire arrangement table having an upstream side in proximity to the wire supplies and a downstream side spaced from the upstream side along the wire feeding direction, a connector connecting unit provided at the upstream side of the wire arrangement table for connecting at least one connector with the respective wires, a connector fixing unit provided at the downstream side of the wire arrangement table for fixing the connector connected with the wires, a wire lifting unit provided at a selected location slightly downstream from the connector connecting unit for substantial simultaneously lifting the wires, and a wire length adjusting unit intermediate the wire lifting unit and the downstream end of the wire arrangement table and comprising an integrally formed wire length adjusting tool having a side facing the wires formed with a plurality of steps having a specified inclination, such that said steps comprise a first step closer to the wires than the other of said steps and aligned with one of said wires for defining the radially outer most wire in the curve, a second step spaced further from the wires than the other of said steps and aligned with a second of said wires for defining the radially inner most wire in the curve and at least one intermediate step aligned with at least a third wire to be disposed between the inner most and outer most wires in the curve, the wire length adjusting tool being selectively movable substantially perpendicular to the parallel wires toward and away from the wires, such that said steps can be brought into contact with the wires on the wire arrangement table to set different loosened lengths for the respective wires that enable said wires to remain in said plane through said curve.

2. An apparatus according to claim 1, further comprising a wire aligning unit disposed between the wire feeding unit and the wire arrangement table for aligning, substantially in parallel, the plurality of wires fed by the wire feeding unit.

3. An apparatus according to claim 1, wherein the connector connecting unit is constructed such that two connectors are settable along the wire feeding direction, and comprises pressing devices for pressing the wires so as to connect them with the respective connectors and at least one wire cutter for cutting the wires between the connection positions of both connectors.

4. An apparatus according to claim 1, further comprising a wiring fixing unit between the connector fixing unit and the wire length adjusting unit and comprising a wire fixing device, for fixedly holding the respective wires in at least one predetermined or predeterminable position.

5. An apparatus according to claim 1, wherein the plurality of substantially parallel wires arranged in a plane comprise at least a first array of linear wires upstream from the curve and at least a second array of linear wires downstream of the curve, said apparatus further comprising at least one wire portion fixing unit having a sheet member adhering unit provided between the connector fixing unit and one of the wire length adjusting unit and the connector connecting unit for fixing adjacent wire portions to each other in locations corresponding to at least one of the arrays of linear wires by adhering a connecting sheet member over the substantially linear and substantially parallel portions of the respective wires.

6. An apparatus for producing a flat wiring harness having a plurality of substantially parallel wires arranged in a plane and aligned to define at least one curve of said substantially parallel wires in said plane, at least one upstream section located upstream from said curve and having said wires aligned substantially linearly and at least one downstream section located downstream from said curve and having said wires aligned substantially linearly, each said wire in said flat wiring harness having an upstream end and a downstream end, said plurality of wires being substantially aligned with one another at said upstream and downstream ends, said apparatus comprising:

a wire feeding unit for feeding the plurality of wires along a wire feeding direction from a plurality of wire supplies;

a wire arrangement table for substantially linearly arranging the plurality of wires, the wire arrangement table having an upstream side in proximity to the wire supplies and a downstream side spaced from the upstream side along the wire feeding direction;

a connector connecting unit provided at the upstream side of the wire arrangement table for substantially simultaneously connecting an upstream connector and a downstream connector to the plurality of wires, the upstream connector being disposed between the downstream connector and the downstream end of the wire arrangement table, the connector connecting unit further comprising a wire cutting unit for cutting the wires between the upstream connector and the downstream connector;

a connector fixing unit at the downstream side of the wire arrangement table for fixing the downstream connector connected with the wires;

a wire length adjusting unit disposed between the connector connecting unit and the connector fixing unit and comprising a wire length adjusting tool integrally formed with a plurality of steps successively offset from one another at a selected angle of inclination, said wire length adjusting tool being movable toward and away from the wires such that the steps contact the wires successively and lengthen the respective wires amounts selected to enable said wires to remain substantially parallel and substantially coplanar through said curve, said wire length adjusting tool being operative before operation of the connector connecting unit for adjusting the lengths of the wires prior to connecting the wires to the upstream connector in the respective flat wiring harness; and at least one sheet member adhering unit for adhering at least one sheet of material to at least a selected one of the upstream and downstream sections of the wire adjacent the curve.

7. An apparatus according to claim 6, further comprising a wire lifting unit provided in proximity to the connector connecting unit for lifting the plurality of wires simultaneously and substantially equal amounts from the wire arrangement table, the connector connecting unit comprising means for inserting the upstream and downstream connectors between the wire arrangement table and each of the plurality of the wires in the flat wiring harness.

* * * * *